US008502848B2

(12) United States Patent
Busch et al.

(10) Patent No.: US 8,502,848 B2
(45) Date of Patent: Aug. 6, 2013

(54) MULTICOLOR THERMAL IMAGING METHOD AND THERMAL PRINTER

(75) Inventors: Brian D. Busch, Sudbury, MA (US); Fariza B. Hasan, Waltham, MA (US); Chien Liu, Wayland, MA (US); Stephen J. Telfer, Arlington, MA (US); William T. Vetterling, Lexington, MA (US)

(73) Assignee: Zink Imaging, Inc., Bedford, MA (US)

( * ) Notice: Subject to any disclaimer, the term of this patent is extended or adjusted under 35 U.S.C. 154(b) by 0 days.

(21) Appl. No.: 13/306,490

(22) Filed: Nov. 29, 2011

(65) Prior Publication Data

US 2012/0169824 A1 Jul. 5, 2012

Related U.S. Application Data

(60) Continuation of application No. 12/827,315, filed on Jun. 30, 2010, now Pat. No. 8,068,126, which is a continuation of application No. 12/166,144, filed on Jul. 1, 2008, now Pat. No. 7,768,540, which is a division of application No. 11/400,735, filed on Apr. 6, 2006, now Pat. No. 7,408,563.

(60) Provisional application No. 60/668,702, filed on Apr. 6, 2005, provisional application No. 60/668,800, filed on Apr. 6, 2005.

(51) Int. Cl.

| | |
|---|---|
| ***B41J 2/32*** | (2006.01) |
| ***B41M 5/00*** | (2006.01) |
| ***B41M 5/26*** | (2006.01) |
| ***B41M 5/34*** | (2006.01) |
| ***B41M 5/40*** | (2006.01) |

(52) U.S. Cl.
USPC ..... 347/221; 347/175

(58) Field of Classification Search
USPC ..... 347/171, 172, 173, 174, 175, 176
See application file for complete search history.

(56) References Cited

U.S. PATENT DOCUMENTS

| | | | |
|---|---|---|---|
| 4,039,065 | A | 8/1977 | Seki et al. |
| 4,284,876 | A | 8/1981 | Ishibashi et al. |

(Continued)

FOREIGN PATENT DOCUMENTS

| | | |
|---|---|---|
| JP | 59-194886 | 11/1984 |
| JP | 05-220990 | 8/1993 |

(Continued)

OTHER PUBLICATIONS

PCT International Search Report—(PCT/US06/13293) Date of Mailing Jul. 30, 2008.

(Continued)

*Primary Examiner* — Huan Tran
(74) *Attorney, Agent, or Firm* — Foley & Lardner LLP; Michael Morency

(57) ABSTRACT

A multicolor direct thermal imaging method wherein a multicolor image is formed in a thermal imaging member comprising at least first and second different image-forming compositions and a thermal printer for use in practicing the method. Heat is applied to at least the second image-forming composition while the first image-forming composition is at a first baseline temperature ($T_1$) to form an image in at least the second image-forming composition, and heat is applied to at least the first image-forming composition while it is at a second baseline temperature ($T_2$) to form an image in at least the first image-forming composition, wherein $T_1$ is different from $T_2$.

8 Claims, 10 Drawing Sheets

U.S. PATENT DOCUMENTS

| | | | | | |
|---|---|---|---|---|---|
| 4,376,942 | A | | 3/1983 | Toth et al. | |
| 4,748,455 | A | | 5/1988 | Mori et al. | |
| 4,755,831 | A | * | 7/1988 | Sakamoto | 347/172 |
| 4,789,872 | A | * | 12/1988 | Hosoi | 347/175 |
| 4,857,941 | A | * | 8/1989 | Kaida | 347/175 |
| 5,172,130 | A | | 12/1992 | Takahashi et al. | |
| 5,191,357 | A | | 3/1993 | Ono et al. | |
| 5,319,392 | A | | 6/1994 | Durst et al. | |
| 5,327,165 | A | | 7/1994 | Elliott et al. | |
| 5,376,952 | A | | 12/1994 | Kokubo et al. | |
| 5,398,050 | A | | 3/1995 | Sato | |
| 5,451,988 | A | | 9/1995 | Ono et al. | |
| 5,453,776 | A | | 9/1995 | Gunther et al. | |
| 5,529,408 | A | | 6/1996 | Moriguchi et al. | |
| 5,610,649 | A | | 3/1997 | Kokubo et al. | |
| 5,680,168 | A | | 10/1997 | Kokubo et al. | |
| 5,699,100 | A | | 12/1997 | Fukuda et al. | |
| 5,729,274 | A | | 3/1998 | Sato | |
| 5,739,840 | A | | 4/1998 | Imai | |
| 5,815,191 | A | | 9/1998 | Michielsen et al. | |
| 6,037,961 | A | | 3/2000 | Saito et al. | |
| 6,078,343 | A | | 6/2000 | Jordan | |
| 6,108,017 | A | | 8/2000 | Katakura et al. | |
| 6,146,031 | A | | 11/2000 | Hu et al. | |
| 6,222,572 | B1 | | 4/2001 | Kurachi et al. | |
| 6,406,127 | B1 | | 6/2002 | Mandel et al. | |
| 6,444,959 | B1 | | 9/2002 | Itoh et al. | |
| 6,447,181 | B1 | | 9/2002 | Hagstrom et al. | |
| 6,532,032 | B2 | | 3/2003 | Dunham et al. | |
| 6,598,950 | B1 | | 7/2003 | Hosono et al. | |
| 6,731,318 | B2 | | 5/2004 | Aigner et al. | |
| 6,744,455 | B2 | | 6/2004 | Coons et al. | |
| 6,801,233 | B2 | | 10/2004 | Bhatt et al. | |
| 7,008,759 | B2 | | 3/2006 | Cheon et al. | |
| 7,166,558 | B2 | * | 1/2007 | Bhatt et al. | 503/204 |
| 7,176,161 | B2 | | 2/2007 | Chu et al. | |
| 7,279,264 | B2 | | 10/2007 | Cheon et al. | |
| 7,282,317 | B2 | | 10/2007 | Allen et al. | |
| 7,408,563 | B2 | * | 8/2008 | Busch et al. | 347/171 |
| 7,635,660 | B2 | * | 12/2009 | Bhatt et al. | 503/204 |
| 7,768,540 | B2 | * | 8/2010 | Busch et al. | 347/173 |
| 7,820,370 | B2 | * | 10/2010 | Busch et al. | 430/333 |
| 8,068,126 | B2 | * | 11/2011 | Busch et al. | 347/175 |
| 2004/0170932 | A1 | | 9/2004 | Hardin et al. | |
| 2004/0204317 | A1 | | 10/2004 | Cheon et al. | |

FOREIGN PATENT DOCUMENTS

| | | |
|---|---|---|
| JP | 06-344582 | 12/1994 |
| WO | WO-02/096665 | 12/2002 |

OTHER PUBLICATIONS

PCT International Search Report—(PCT/US06/13294) Date of Mailing Jul. 30, 2008.

Supplementary European Search Report—(EP 06749646) Date of completion of the search Apr. 21, 2010.

* cited by examiner

MULTICOLOR THERMAL IMAGING METHOD AND THERMAL PRINTER

REFERENCE TO RELATED APPLICATIONS

This application is a continuation of U.S. patent application Ser. No. 12/827,315, filed Jun. 30, 2010, which is a continuation of U.S. patent application Ser. No. 12/166,144, filed Jul. 1, 2008, which is a divisional of U.S. patent application Ser. No. 11/400,735, filed Apr. 6, 2006, which claims the benefit of prior provisional patent applications application Ser. Nos. 60/668,702 and 60/668,800, both filed Apr. 6, 2005. The contents of the foregoing applications are incorporated herein by reference in their entireties.

This application is related to the following commonly assigned, United States patent applications and patents, the entire disclosures of which are hereby incorporated by reference herein in their entirety:

U.S. Pat. No. 6,801,233 B2;

U.S. Pat. No. 6,906,735 B2;

U.S. Pat. No. 6,951,552 B2;

U.S. Pat. No. 7,008,759, B2;

U.S. patent application Ser. No. 10/806,749, filed Mar. 23, 2004, which is a division of U.S. Pat. No. 6,801,233 B2;

United States Patent Application Publication No. US2004/0176248 A1;

United States Patent Application Publication No. US2004/0204317 A1;

United States Patent Application Publication No. US2004/0171817 A1; and

U.S. patent application Ser. No. 11/400,734; filed on even date herewith.

FIELD OF THE INVENTION

The present invention relates generally to a direct thermal imaging method and printer and, more particularly, to a multicolor thermal imaging method and printer for use therein, wherein heat is applied selectively to at least two, and preferably three, image-forming layers of a thermal imaging member to form a multicolored image.

BACKGROUND OF THE INVENTION

Direct thermal imaging is a technique in which a substrate bearing at least one image-forming layer, which is typically initially colorless, is heated by contact with a thermal printing head to form an image. In direct thermal imaging there is no need for ink, toner, or thermal transfer ribbon. Rather, the chemistry required to form an image is present in the imaging member itself. Direct thermal imaging is commonly used to make black and white images, and is often employed for the printing of, for example, labels and store receipts. There have been described in the prior art numerous attempts to achieve multicolor direct thermal printing. A discussion of various direct thermal color imaging methods is provided in U.S. Pat. No. 6,801,233 B2.

It is known in the art to preheat a thermally activated printing head in a thermal imaging, application. For example, U.S. Pat. No. 5,191,357 describes a recording apparatus for performing recording on a recording medium where the apparatus includes a plurality of recording elements and a control unit for selectively providing energy having a level lower than an actual recording level. It is also known to preheat a thermal transfer ink layer in a thermal transfer imaging method. For example, U.S. Pat. No. 5,529,408 discloses a thermal transfer recording method wherein the thermal transfer ink layer is preheated prior to having energy applied thereto in order to initiate transfer of the ink to a receiving material.

As the state of the thermal imaging art advances, efforts continue to be made to provide thermal imaging materials and thermal imaging methods that can meet new performance requirements.

SUMMARY OF THE INVENTION

It is therefore an object of this invention to provide a novel, multicolor, direct thermal imaging method.

It is another object to provide a multicolor direct thermal imaging method wherein at least two, and preferably three, different image-forming compositions are addressed by heating to form a multicolored image.

It is a further object of the invention to provide a multicolor direct thermal imaging method that is practiced with a thermal imaging member having three different image-forming layers.

Yet another object is to provide such a multicolor direct thermal imaging method wherein at least two, and preferably three, different image-forming layers of an imaging member are heated directly or indirectly when heat is applied to a particular layer of the thermal imaging member. In a preferred embodiment, heat is applied to layer closest to the surface of the imaging member using at least one thermal printing head.

Hereinafter, when a particular image-forming layer is described as being heated, or when heat is described as being applied to a particular image-forming layer, it is to be understood that such heating may be direct heating (by, for instance, contact with a hot object or by absorption of light and conversion to heat in the layer itself) or indirect heating (in which a neighboring region or layer of the thermal imaging member is directly heated, and the particular layer considered is heated by diffusion of heat from the directly heated region).

In one aspect of the invention there is provided a multicolor direct thermal imaging method wherein a multicolor image is formed in a thermal imaging member comprising at least a first and a second different image-forming compositions. Heat is applied to at least the second image-forming composition while the first image-forming composition is at a first baseline temperature ($T_1$) to form an image in at least the second image-forming composition, and heat is applied to at least the first image-forming composition while it is at a second baseline temperature ($T_2$) to form an image in at least the first image-forming composition, wherein $T_1$ is different from $T_2$.

In another aspect of the invention there is provided a multicolor direct thermal imaging method wherein an image is formed by heating at least a first and a second different image-forming layer of a thermal imaging member. In accordance with the method, the second image-forming layer is heated to form an image in the second image-forming layer while the first image-forming layer is at a first baseline temperature, and the first image-forming layer is heated to form an image in the first image-forming layer while it is at a second baseline temperature, where the second baseline temperature is different from the first baseline temperature.

More particularly, in accordance with a preferred embodiment of the present invention, heat is applied to a particular region of the second image-forming layer to form an image in that layer while the first image-forming layer is at a first baseline temperature ($T_1$), and heat is applied to a region of the first image-forming layer that corresponds to the aforementioned particular region of the second image-forming layer to form an image in the first image-forming layer while it is at a second baseline temperature ($T_2$), in such a way that an image of more than one color is formed in the thermal imaging member, and where $T_1$ is not the same as $T_2$.

The particular region of the second image-forming layer mentioned above can be, for example, a particular pixel in an image. The region of the first image-forming layer that corresponds to the particular region of the second image-forming layer is intended herein to refer to a region in which the image formed in the first image-forming layer is perceived by the viewer to overlap with the image formed in the particular region of the second image-forming layer. For example, the region of the first image-forming layer that corresponds to the particular region of the second image-forming layer could be the corresponding pixel in the first image-forming layer.

In one preferred embodiment, there is provided a direct thermal, multicolor thermal imaging method wherein heat is applied to a thermal imaging member having at least a first, a second, and a third image-forming layers having activating temperatures of $Ta_1$, $Ta_2$ and $Ta_3$, respectively, to form an image in the thermal imaging member. In accordance with the method, heat is applied to the third image-forming layer to form an image in that layer while the first image-forming layer is at a first baseline temperature ($T_1$); heat is applied to the second image-forming layer to form an image in that layer while the first image-forming layer is at a second baseline temperature ($T_2$); and heat is applied to the first image-forming layer to form an image in that layer it is at a third baseline temperature ($T_3$); wherein at least one of $T_1$, $T_2$ and $T_3$ is not the same as at least another of $T_1$, $T_2$ and $T_3$.

In a preferred embodiment, the third image-forming layer, the second image-forming layer and the first image-forming layer are located, in that order, at increasing distance from the surface of the imaging member.

There is also provided a thermal printer for use in the preferred methods, comprising transporting means for transporting a thermal imaging member, at least a first and a second thermal printing head, each making contact with the same surface of the thermal imaging member and each comprising a row of heating elements that are oriented transverse to the direction of transport of the thermal imaging member, and at least one preheating means.

BRIEF DESCRIPTION OF THE DRAWINGS

For a better understanding of the invention as well as other objects and advantages and further features thereof, reference is made to the following detailed description of various preferred embodiments thereof taken in conjunction with the accompanying drawings wherein.

DESCRIPTION OF THE PREFERRED EMBODIMENTS

Figure 1:
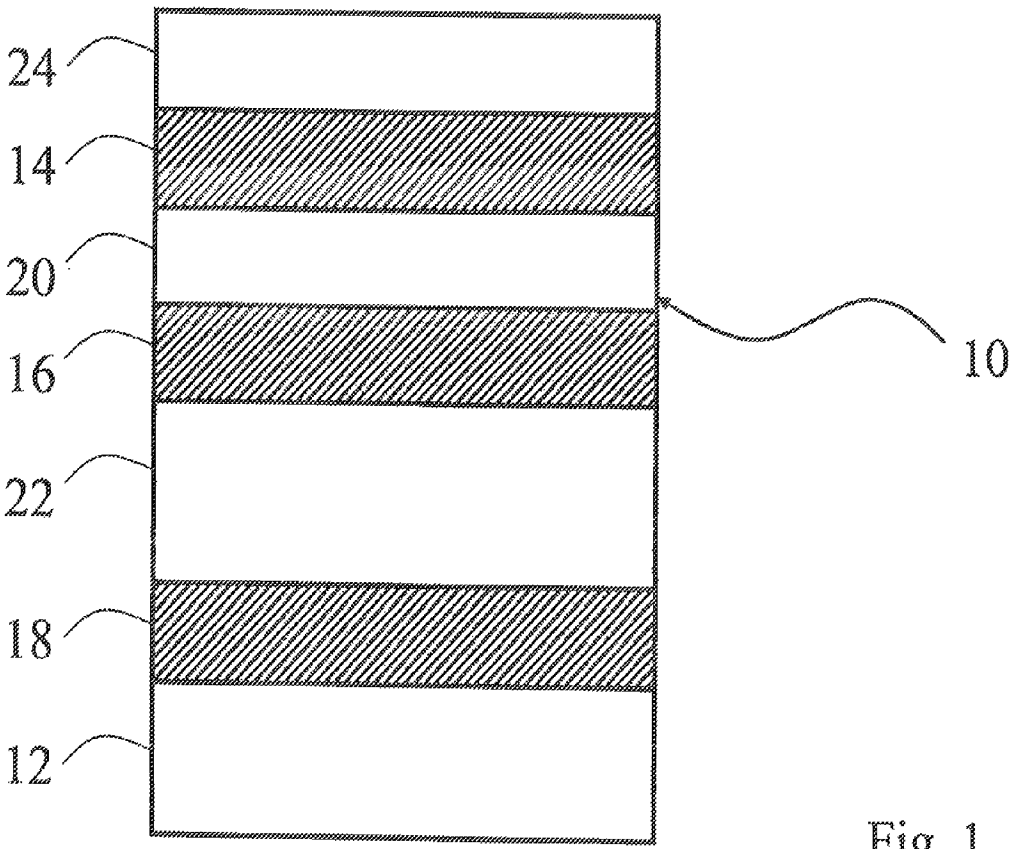
FIG. 1 is a partially schematic, side sectional view of a multicolor thermal imaging member that can be utilized in the method of the invention.

Specific preferred embodiments of the invention will be described with respect to the drawings, which illustrate thermal imaging members for use with the present thermal imaging method. Referring now to FIG. 1, there is seen a thermal imaging member 10 that includes a substrate 12, that can be transparent, absorptive, or reflective, and three image-forming layers 14, 16, and 18, which may be cyan, magenta and yellow, respectively, spacer layers 20 and 22, and an optional overcoat layer 24.

Each image-forming layer can change color, e.g., from initially colorless to colored, where it is heated to a particular temperature referred to herein as its activating temperature. Any order of the colors of the image-forming layers can be chosen. One preferred color order is as described above. Another preferred order is one in which the three image-forming layers 14, 16, and 18 are yellow, magenta and cyan, respectively.

Spacer layer 20 is preferably thinner than spacer layer 22, provided that the materials comprising both layers have substantially the same thermal diffusivity. The function of the spacer layers is control of thermal diffusion within the imaging member 10. Preferably, spacer layer 22 is at least four times thicker than spacer layer 20.

All the layers disposed on the substrate 12 are substantially transparent before color formation. When the substrate 12 is reflective (e.g., white), the colored image formed on imaging member 10 is viewed through the overcoat 24 against the reflecting background provided by the substrate 12. The transparency of the layers disposed on the substrate ensures that combinations of the colors printed in each of the image-forming layers may be viewed.

In the preferred embodiments of the invention where the thermal imaging member includes at least three image-forming layers, all the image-forming layers may be arranged on the same side of a substrate, or two or more of the image-forming layers may be arranged on one side of a substrate with one or more image-forming layers being arranged on the opposite side of the substrate.

In preferred embodiments of the method of the invention, the image-forming layers are addressed at least partially independently by variation of two adjustable parameters, namely, temperature and time. These parameters can be adjusted in accordance with the invention to obtain the desired results in any particular instance by selecting the temperature of the thermal printing head and the period of time during which heat is applied to the thermal imaging member. Thus, each color of the multicolor imaging member can be printed alone, or in selectable proportion with the other colors. As will be described in detail, in these embodiments the temperature-time domain is divided into regions corresponding to the different colors that it is desired to obtain in the final image.

Depending upon the printing time, available printing power, and other factors, various degrees of independence in the addressing of the image forming layers can be achieved. The term "independently" is used to refer to instances in which the printing of one color-forming layer typically results in a very small, but mot generally visible optical density (density<0.05) in the other color-forming layer(s). In the same manner, the term "substantially independent" color printing is used to refer to instances in which inadvertent or unintentional coloration of another image-forming layer or layers results in a visible density which is at a level typical of interimage coloration in multicolor photography (density<0.2). The term "partially independent" addressing of the image-forming layers is used to refer to instances in which the printing of maximum density in the layer being addressed results in the coloration of another image-forming layer or layers at a density higher than 0.2 but not higher than about 1.0. The phrase "at least partially independently" is inclusive of all of the degrees of independence described above;

The image-forming layers of the thermal imaging member undergo a change in color to provide the desired image in the imaging member. The change in color may be from colorless to colored, from colored to colorless, or from one color to another. The term "image-forming layer" as used throughout the application, including in the claims, includes all such embodiments. In the case where the change in color is from colorless to colored, an image having different levels of optical density (i.e., different "gray levels") of that color may be obtained by varying the amount of color in each pixel of the image from a minimum density, Dmin, which is substantially colorless, to a maximum density, Dmax, in which the maximum amount of color is formed. In the case where the change in color is from colored to colorless, different gray levels are obtained by reducing the amount of color in a given pixel from Dmax to Dmin, where ideally Dmin is substantially colorless.

According to a preferred embodiment of the invention, each of the image-forming layers 14, 16 and 18 is independently addressed by application of heat with a thermal printing head in contact with the topmost layer of the member, optional overcoat layer 24 in the member illustrated in FIG. 1. The activating temperature ($Ta_3$) of the third image-forming layer 14 (as counted from the substrate 12, i.e., the image-forming layer closest to the surface of the thermal imaging member)) is greater than the activating temperature ($Ta_2$) of the second image-forming layer 16, which in turn is greater than the activating temperature ($Ta_1$) of the first image-forming layer 18. Delays in heating of image-forming layers at greater distances from the thermal printing head are provided by the time required for heat to diffuse to these layers through the spacer layers. Such delays in heating permit the image-forming layers closer to the thermal printing head to be heated to above their activating temperatures without activating the image-forming layer or layers below them even though these activating temperatures can be substantially higher than the activating temperatures for the lower image-forming layers (those that are farther away from the thermal printing head). Thus, when addressing the uppermost image-forming layer 14 the thermal printing head is heated to a relatively high temperature, but for a short time, such that insufficient heat is transferred to the other image-forming layers of the imaging member to provide image information to either of image-forming layers 16 and 18.

The heating of the lower image-forming layers, i.e., those closer to the substrate 12 (in this case image-forming layers 16 and 18) is accomplished by maintaining the thermal printing head at temperatures such that the upper image-forming layer(s) remain below their activating temperatures for sufficient periods of time to allow heat to diffuse through them to reach the lower image-forming layer(s). In this way, no image information is provided in the upper image-forming layer(s) when the lower image-forming layer(s) are being imaged. The heating of the image-forming layers according to the method of the invention may be accomplished by two passes of a single thermal printing head, or by a single pass of each of more than one thermal printing head, as is described in detail below.

Although the heating of imaging member 10 is preferably carried out using a thermal printing head, any method providing controlled heating of the thermal imaging member may be used in the practice of the present invention. For example, a modulated source of light (such as a laser) may be used. In this case, as is well known in the art, an absorber for light of a wavelength emitted by the laser must be provided in the thermal imaging member or in contact with the surface of the imaging member.

When a thermal printing head (or other contact heating element) is used to heat the thermal imaging member 10, heat diffuses into the bulk of the thermal imaging member from the layer in contact with the thermal printing head (typically, overcoat layer 24). When a source of light is used for heating, the layer or layers containing an absorber for the light will be heated as light is converted to heat in these layers, and heat will diffuse from these layers throughout the thermal imaging member. It is not necessary that the light-absorbing layers be at the surface of the imaging member, provided that the layers of the thermal imaging member separating the source of light from the absorbing layers are transparent to light of the wavelength to be absorbed. In the discussion below it is assumed that the layer that is directly heated is the overcoat layer 24, and that heat diffuses from this layer into the thermal imaging member, but similar arguments apply whichever layer or layers of the thermal imaging member 10 is (or are) heated.

Figure 2:
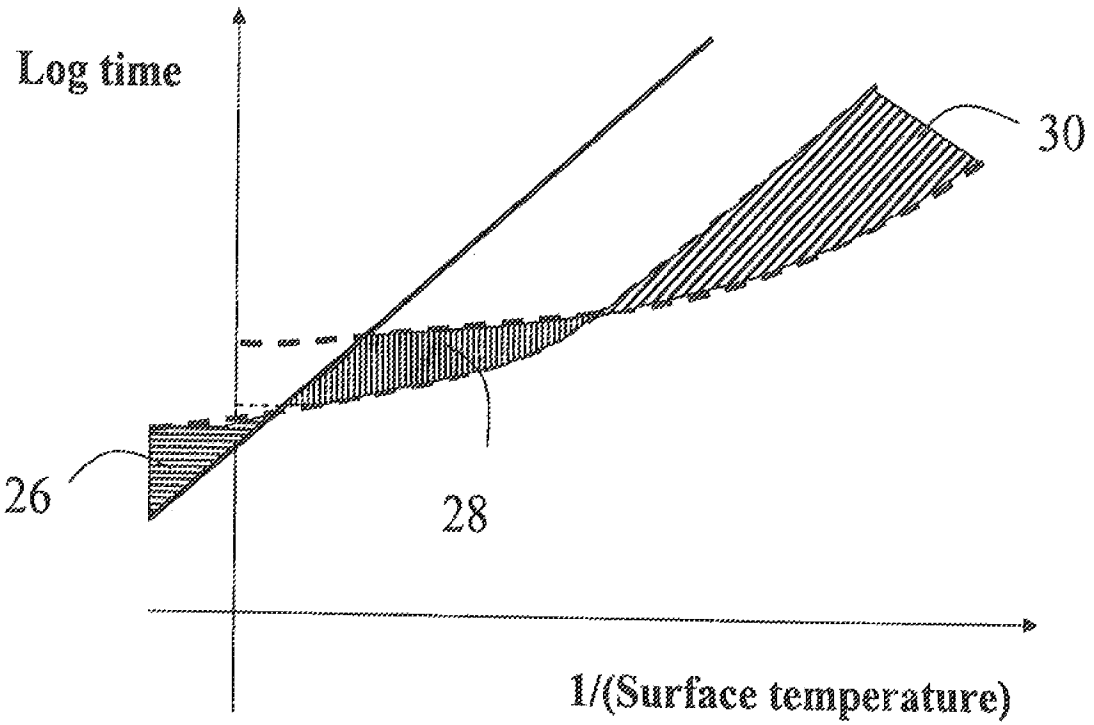
FIG. 2 is a graphical illustration showing the relative times and temperatures of heating required to address the separate colors of a multicolor thermal imaging member.

FIG. 2 is a graphical illustration showing the thermal printing head temperatures and times of heating required to address image-forming layers 14, 16 and 18, assuming that these layers are all initially at ambient temperature. The axes of the graph in FIG. 2 show the logarithm of the heating time and the reciprocal of the absolute temperature at the surface of the imaging member 10 that is in contact with the thermal printing head. Region 26 (relatively high printing head temperature and relatively short heating time) provides imaging of image-forming layer 14, region 28 (intermediate printing head temperature and intermediate heating time) provides-imaging of image-forming layer 16 and region 30 (relatively low printing head temperature and relatively long heating time) provides imaging of image-forming layer 18. The time required for imaging image-forming layer 18 is substantially longer than the time required for imaging image-forming layer 14.

The activating temperatures selected for the image-forming layers are generally in the range of about 90° C. to about 300° C. The activating temperature ($Ta_1$) of the first image-forming layer 18 is preferably as low as possible consistent with thermal stability of the imaging member during shipment and storage and preferably is about 100° C. or more. The activating temperature ($Ta_3$) of the third image-forming layer 14 is preferably as low as possible consistent with allowing the activation of the second and third image-forming layers 16 and 18 by heating through this layer without activating it according to the method of the invention, and preferably is about 200° C. or more. The activating temperature ($Ta_2$) of the second image-forming layer is between $Ta_2$ and $Ta_3$ and is preferably between about 140° C. and about 180° C.

Thermal printing heads used in the method of the present invention typically include a substantially linear array of resistors that extends across the entire width of the image to be printed. In some embodiments the width of the thermal printing head may be less than that of the image. In such cases the thermal printing head may be translated relative to the thermal imaging member in order to address the entire width of the image, or else more than one thermal printing head may be used. The imaging member is typically imaged while being transported in a direction perpendicular to the line of resistors on the printing head while pulses of heat are provided by supplying electrical current to these resistors. The time period during which heat can be applied to thermal imaging member 10 by a thermal printing head is typically in the range of about 0.001 to about 100 milliseconds per line of the image. The lower limit may be defined by the constraints of the electronic circuitry, while the upper limit is set by the need to print an image in a reasonable length of time. The spacing of the dots that make up the image is generally in the range of 100-600 lines per inch in directions both parallel and transverse to the direction of motion, and is not necessarily the same in each of these directions.

Figure 3:
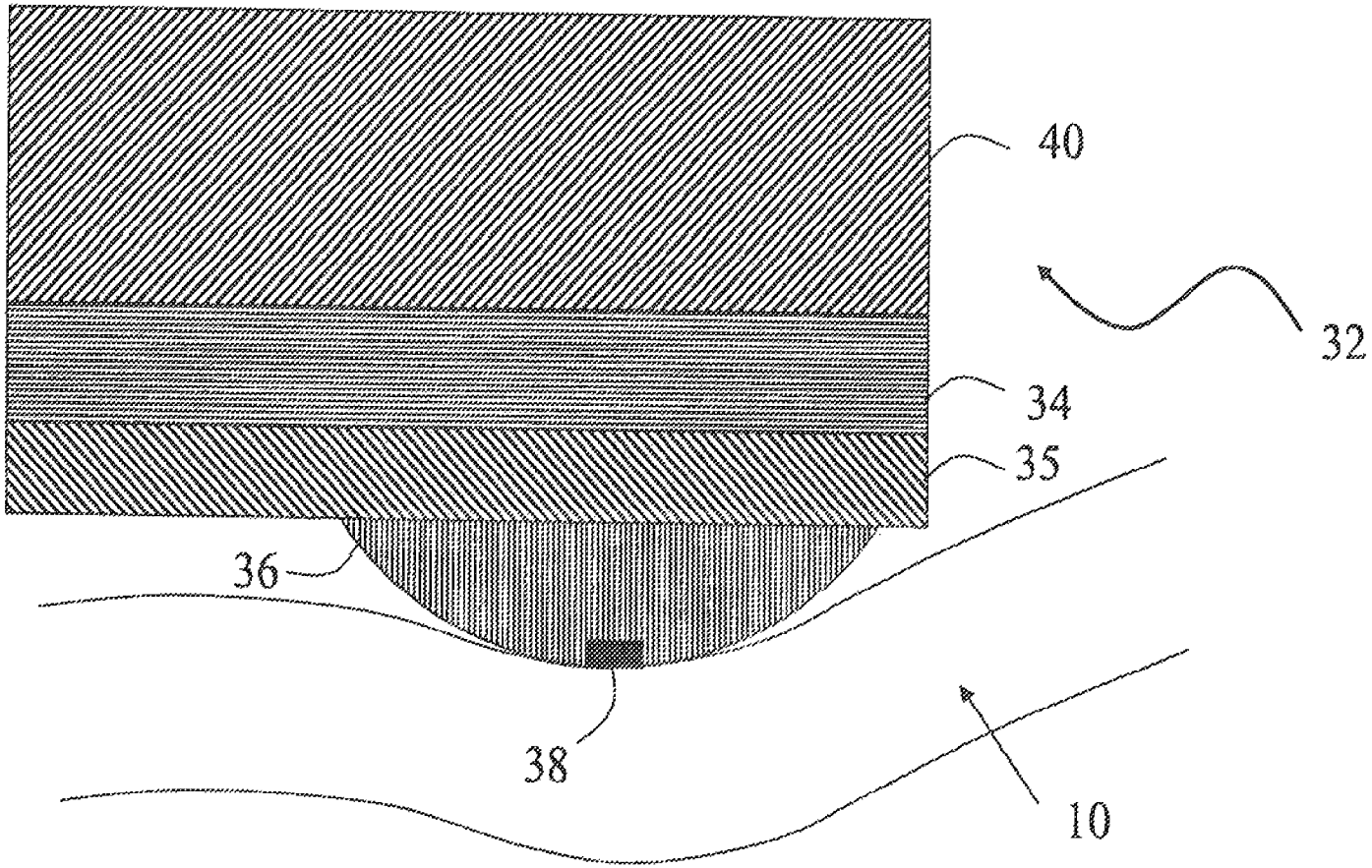
FIG. 3 is a schematic, side sectional view of a thermal printing head in contact with a multicolor thermal imaging member.

FIG. 3 shows in schematic form the area of contact between a typical thermal printing head and the thermal imaging member. The thermal printing head 32 comprises a substrate 34 on which is located a glaze element 35. Optionally, glaze element 35 also comprises a "glaze bump" 36 whose curved surface protrudes from the surface of glaze 35. The resistors 38 are located on the surface of this glaze bump 36, when it is present, or are located on the surface of the flat glaze element 35. An overcoat layer or layers may be deposited over the resistors 38, glaze element 35, and optional glaze bump 36. The combination of glaze element 35 and optional glaze bump 36, both of which which are typically composed of the same material, is hereinafter referred to as the "printing head glaze". In thermal contact with substrate 34 is a heat sink 40, which is typically cooled in some manner (for example, by use of a fan). The thermal imaging member 10 may be in thermal contact with the printing head glaze (typically through the overcoat layer or layers) over a length substantially greater than the length of the actual heating resistor. Thus, a typical resistor may extend about 120 microns in the direction of transport of the thermal imaging medium 10, but the area of thermal contact of the thermal imaging member with the printing head glaze may be 200 microns or more.

During the formation of an image, a substantial amount of heat is transferred from the resistors 38 into the printing head glaze, and the temperature of the printing head glaze may rise. Depending upon the speed of printing and the precise area of contact between the thermal imaging member and the printing head glaze, the temperature of the thermal imaging member 10 at the moment of contact with the resistors 38 may not be ambient temperature. Moreover, there may be a gradient of temperature within the thermal imaging member 10 such that the temperatures within each of the image-forming layers are not, the same.

The temperature of an image-forming layer at the moment that the thermal imaging member begins to be heated by the resistors 38 (or other modulated source of heat adapted to form an image in the thermal imaging member) is herein referred to as the "baseline temperature" of that layer. Where a gradient of temperatures exists within the image-forming layer at the time that modulated heating of the thermal imaging member to form an image in the thermal imaging member begins, the baseline temperature of the layer, as that term is used herein, includes the range of temperatures within the gradient. Thus, it should be understood that the term "baseline temperature" is inclusive of a range of temperatures that may be present in different areas of the layer.

Any heating that causes the baseline temperature of an image-forming layer to be greater than ambient temperature is herein referred to as "preheating". Preheating may be effected by thermal contact of the thermal imaging member with the printing head glaze as described above, or by contact with other preheating means as described in more detail below.

Figure 4:
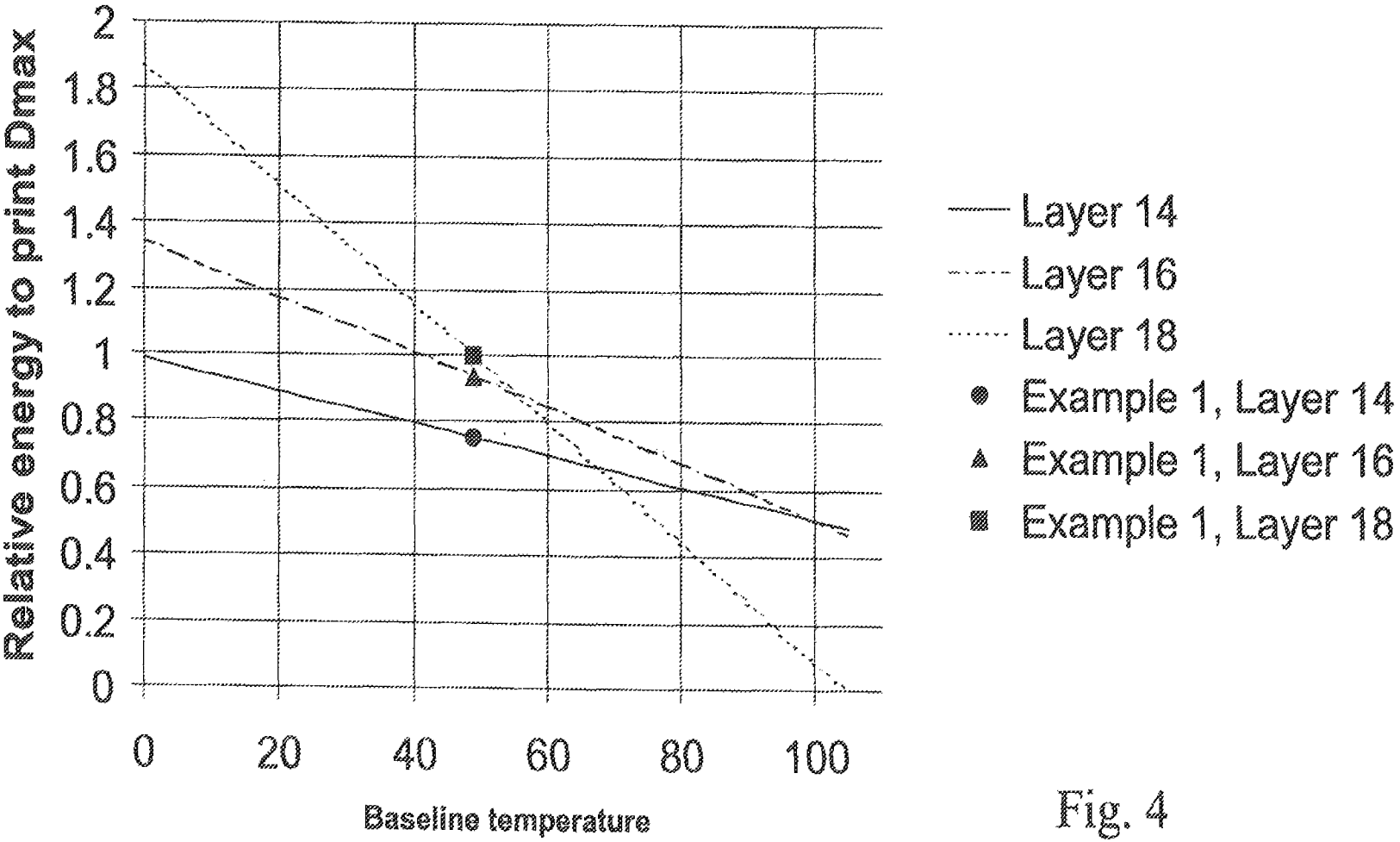
FIG. 4 is a graphical illustration of a rough approximation of the effect of the baseline temperature on the heat required to provide image information to the separate image-forming layers of the multicolor thermal imaging member.

The analysis of time and temperature regions for printing each image-forming layer given above with reference to FIG. 2 carried the assumption that the baseline temperatures for all three image-forming layers of the imaging system were the same, namely ambient temperature. However, the energy required to heat a particular image-forming layer to its activating temperature will depend upon the difference between its activating temperature and its baseline temperature. FIG. 4 shows the relative energies required to print maximum density in each of the image-forming layers according to the method described in Example 1 below, in which the baseline temperatures for the three layers are each 49° C., and the activation temperatures for layers 14, 16 and 18 are 210° C., 161° C., and 105° C., respectively. Also shown in FIG. 4 are lines showing how, according to a simplified model, the energies required to reach Dmax in the three image-forming layers would change with changes in the baseline temperatures of those layers. The assumption made in construction of the chart shown in FIG. 4 is that the amount of energy required to reach Dmax in a particular layer changes linearly with the change in its baseline temperature. Each line intercepts the baseline temperature axis at the activation temperature for that particular image-forming layer, since this is the temperature at which no additional energy would be required to form full density in that layer. As can be seen from FIG. 4, as the baseline temperature of an image-forming layer is raised, the relative change in the amount of heat that must be supplied by the thermal printing head in order to activate it will be greater for image-forming layers with lower activating temperatures.

For example, referring now to FIG. 4, at baseline temperatures of 20° C. for image-forming layers 14 and 18, about 1.7 times more energy needs to be supplied to reach maximum density (Dmax) in layer 18 than must be supplied to image-forming layer 14 to reach Dmax in that layer. At baseline temperatures for these layers of about 68° C., however, about the same amount of energy needs to be supplied to reach Dmax in layer 18 as needs to be supplied to accomplish the same result for layer 14. Above this temperature, less energy needs to be supplied to reach Dmax in layer 18 than must be supplied to accomplish the same result for layer 14, and it becomes impossible to reach Dmax in layer 14 without also reaching Dmax in layer 18. The practice of the present invention therefore involves control of the baseline temperatures of the image-forming layers.

It will be apparent to one of skill in the art that a given baseline temperature for a particular image-forming layer may be obtained in a variety of different ways, which may result in different gradients of temperature within the imaging member. These gradients, moreover, will change over time. It is also possible that a gradient of temperature may exist across the image-forming layer itself. For these reasons, the analysis given above with reference to FIG. 4 is to be regarded as a simplification that is presented as an aid to the understanding of the present invention, and is not intended to limit the invention in any way.

As described above, the rate-limiting layer for forming an image in the thermal imaging member according to the method of the present invention is the most deeply buried image-forming layer, image-forming layer 18 in the imaging member illustrated in FIG. 1. At a baseline temperature of ambient temperature, forming an image in image-forming layer 18 without forming an image in image-forming layer 16 requires a relatively long time for heat diffusion, since a large amount of heat must be transferred into the member at the relatively low temperature that will not provide image information to image-forming layer 16. Referring to FIG. 4, it is seen that the energy that must be supplied to provide image information to image-forming layer 18 is the most significantly affected by a change in baseline temperature. Therefore, according to a preferred embodiment of the present invention, heat is applied to image-forming layers 14 and 16 by a thermal printing head (not necessarily at the same time) while image-forming layer 18 is at a first baseline temperature $T_1$ in a first printing pass, and heat is subsequently applied to image-forming layer 18 in a second printing pass while image-forming layer 18 is at a second baseline temperature $T_2$ which is greater than the first baseline temperature $T_1$ and below the activating temperature of image-forming layer 18. The first baseline temperature, $T_1$, is preferably about ambient temperature, i.e., from about 10° C. to about 30° C. The second baseline temperature is preferably substantially above ambient temperature. The upper limit of the second baseline temperature is defined by the operating temperature range of the thermal printing head and the activating temperature of the image-forming layer 18. A preferred range for temperature $T_2$ is from about 30° C. to about 80° C., and a particularly preferred temperature value of $T_2$ is between about 40° C. and about 70° C.

The first and second passes for the application of heat to the image-forming layers can be carried out sequentially with a single printing head, or by two separate printing heads, spaced apart from each other in the transport direction of the thermal imaging member and printing substantially in parallel, provided in the latter case that the baseline temperature of the image-forming layer 18 is adjusted in some manner between the two thermal printing heads. The use of more than one printing head obviates the need for reciprocating the imaging member beneath a single printing head.

It is also possible that image information can be provided to each of image-forming layers 14, 16 and 18 individually in separate passes of the same printing head (or with separate printing heads) provided that the baseline temperature of image-forming layer 18, when image-forming layers 14 and 16 are being imaged, is substantially $T_1$ (i.e., approximately ambient temperature and below $T_2$). In this case, a total of three passes is required to form an image in all three image-forming layers. In two of these passes, in which image-forming layers 14 and 16 are imaged, image-forming layer 18 is at baseline temperature $T_1$. In the third pass, in which an image is formed in image-forming layer 18, the baseline temperature of layer 18 is $T_2$.

Another variant on a method in which three passes (or three thermal printing heads) are used to form an image in all three image-forming layers is as follows. Image-forming layer 14 is imaged while image-forming layers 16 and 18 are at a baseline temperatures $T[16]_1$ and $T[18]_1$, image-forming layer 16 is imaged while it is at a baseline temperature $T[16]_2$ and image-forming layer 18 is at a baseline temperature $T[18]_2$, and image-forming layer 18 is imaged while it is at a baseline temperature $T[18]_3$. In this case $T[18]_3$ is greater than either $T[18]_1$ or $T[18]_2$, and $T[16]_2$ is greater than $T[16]_1$.

It should be noted that the order in which the separate printing passes of the present invention are carried out is not critical to the practice of the invention.

When forming an image in the thermal imaging member with more than one pass of a thermal printing head, it is not necessary that the speed of the thermal printing head be the same for each pass, nor is it necessary for the baseline temperature for each image-forming layer to be the same for each pass. The use of multiple passes for forming an image in a thermal imaging member according to the present invention introduces a substantial amount of flexibility in the optimization of the overall printing system.

A direct thermal imaging method wherein an image is formed in a thermal imaging member with more than one pass of a thermal printing head, and the speed of the thermal printing head in one pass is different than the speed of the thermal printing head in at least one other pass is disclosed in co-pending commonly-assigned U.S. patent application Ser. No. 11/400,734, filed on even date herewith, the contents of which are incorporated herein by reference in its entirety. The method of the present invention may be carried out with at least one pass of a thermal printing head at a first speed and at least one pass of a thermal printing head at a second different speed.

It is not necessary that the yellow image be formed with as many gray levels as the images in the other two subtractive primary colors. In one embodiment of the invention, the number of gray levels used in forming yellow is deliberately made less than the number of gray levels used for the other colors. In the extreme, it is possible to use a binary image for the yellow image-forming layers (i.e., one with only Dmin and Dmax values allowed in each pixel). Even with such low number of gray levels of the yellow sub-image, the human eye cannot easily discern a loss in the quality of the overall, three-color image. As would be well-known to one skilled in the art, dithering can be used to increase the apparent number of gray levels while trading off spatial resolution.

Although the invention has been described with reference to a thermal imaging member having three different image-forming layers, the same principles can be applied to imaging members comprising only two image-forming layers or having more than three such layers. Moreover, the components required for forming each color may be located in the same layer, but separated from each other in some way, for example by microencapsulation. All that is necessary in the practice of the present invention is that the time of heating of a particular layer of the thermal imaging member (typically the surface layer, as mentioned above) that is required for formation of a first color be shorter than the time of heating of that layer required for formation of a second color, and that the activating temperature for the first color be higher than the activating temperature for the second color.

Figure 5:
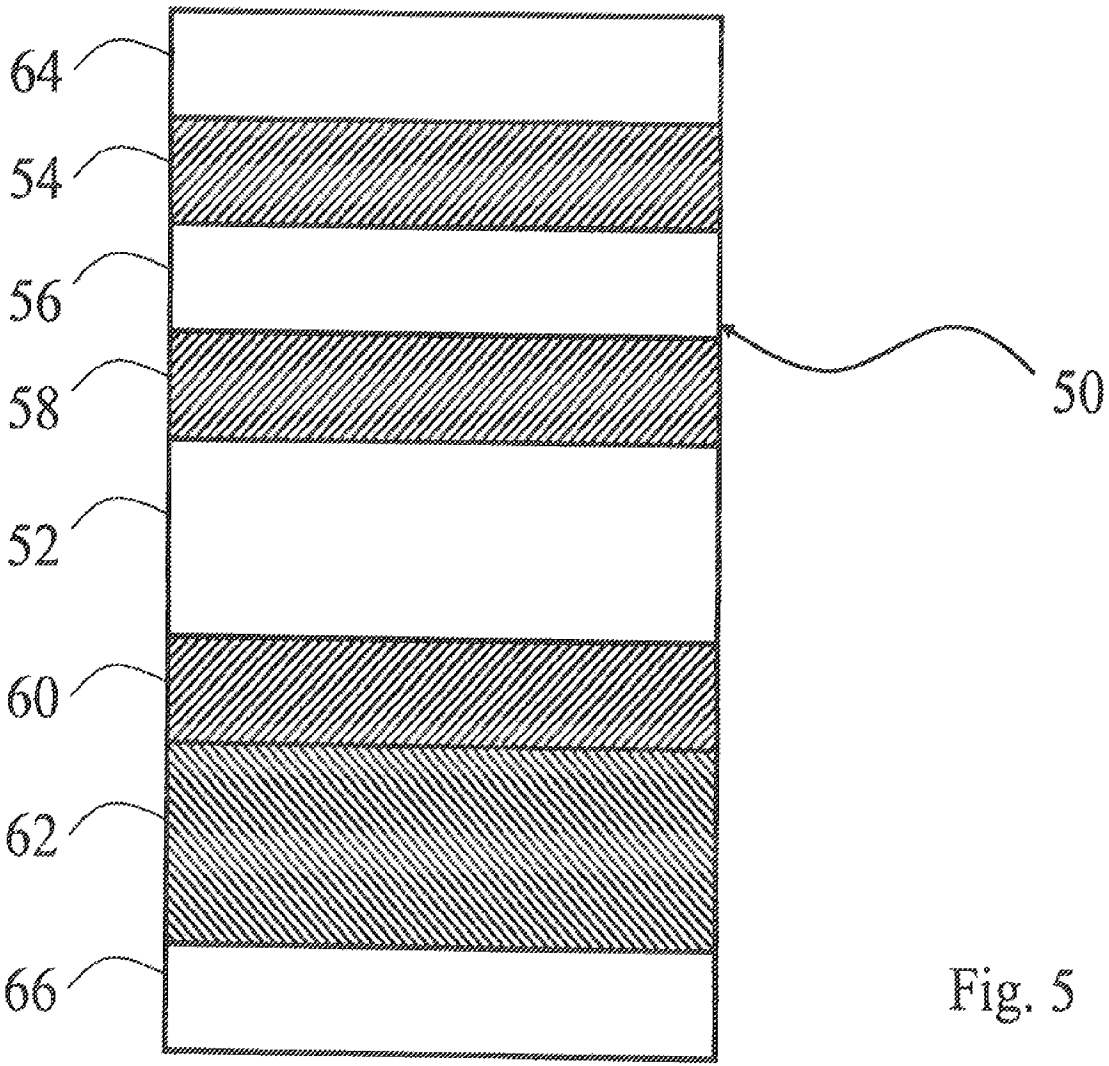
FIG. 5 is a partially schematic, side sectional view of another multicolor thermal imaging member which can be utilized in the method of the invention.

A thermal imaging member having two image-forming layers on one side of a transparent substrate and a third image-forming layer on the reverse side of the substrate is illustrated in FIG. 5 (not to scale). Referring now to FIG. 5 there is seen imaging member 50 which includes substrate 52, a first image-forming layer 58, spacer layer 56, a second image-forming layer 54, a third image-forming layer 60, an optional opaque (e.g., white) layer 62, an optional overcoat layer 64 and an optional backcoat layer 66. In this preferred embodiment of the invention substrate 52 is transparent. The overcoat layer, image-forming layers, spacer layer and backcoat layer may include any of the materials described below as suitable for such layers. The opaque layer 62 may comprise a pigment such as titanium dioxide in a polymeric binder, or may comprise any material providing a reflective, white coating such as would be well known to one skilled in the art.

Using the method of the present invention, formation of an image in image-forming layer 54 may be accomplished in a first pass while image-forming layer 58 is at a first baseline temperature of $T_1$ as described above, and formation of an image in image-forming layer 58 may be accomplished by a second printing pass while this layer is at a second baseline temperature $T_2$, as described above.

Formation of an image in the third image-forming layer 60 is accomplished by printing on the reverse side of imaging member 50 with a thermal printing head, as described in U.S. Pat. No. 6,801,233 B2.

The baseline temperature of any of the image-forming layers within the thermal imaging member as an image is formed therein may be adjusted by a variety of techniques that will be apparent to those skilled in the art. For example, as shown in FIG. 3, the baseline temperature of the thermal imaging member may be affected by thermal contact with the printing head glaze prior to heating by the heating element. The temperature of the printing head glaze may be adjusted in a variety of well-known ways. As described above in FIG. 3, the glaze element 36 of a thermal printing head is typically in indirect thermal contact with a heat sink 40 that may be heated or cooled. Heating may be accomplished by separate resistive heating, by use of a heating fluid, by irradiation (using for example visible light, ultraviolet, infrared, or microwave radiation), by friction, by hot air, by use of the printing head resistors 38 themselves, or by any convenient method that would be well known to one skilled in the art. The heat sink may be cooled by a variety of well-known methods that include the use of fans, cold air, cooling liquid, thermoelectric cooling, and the like. Closed-loop control of the temperature of the heat sink may be achieved by measuring its temperature, for example by using a thermistor and applying heating or cooling as necessary to maintain a constant value, as is well known in the art.

Figure 6:
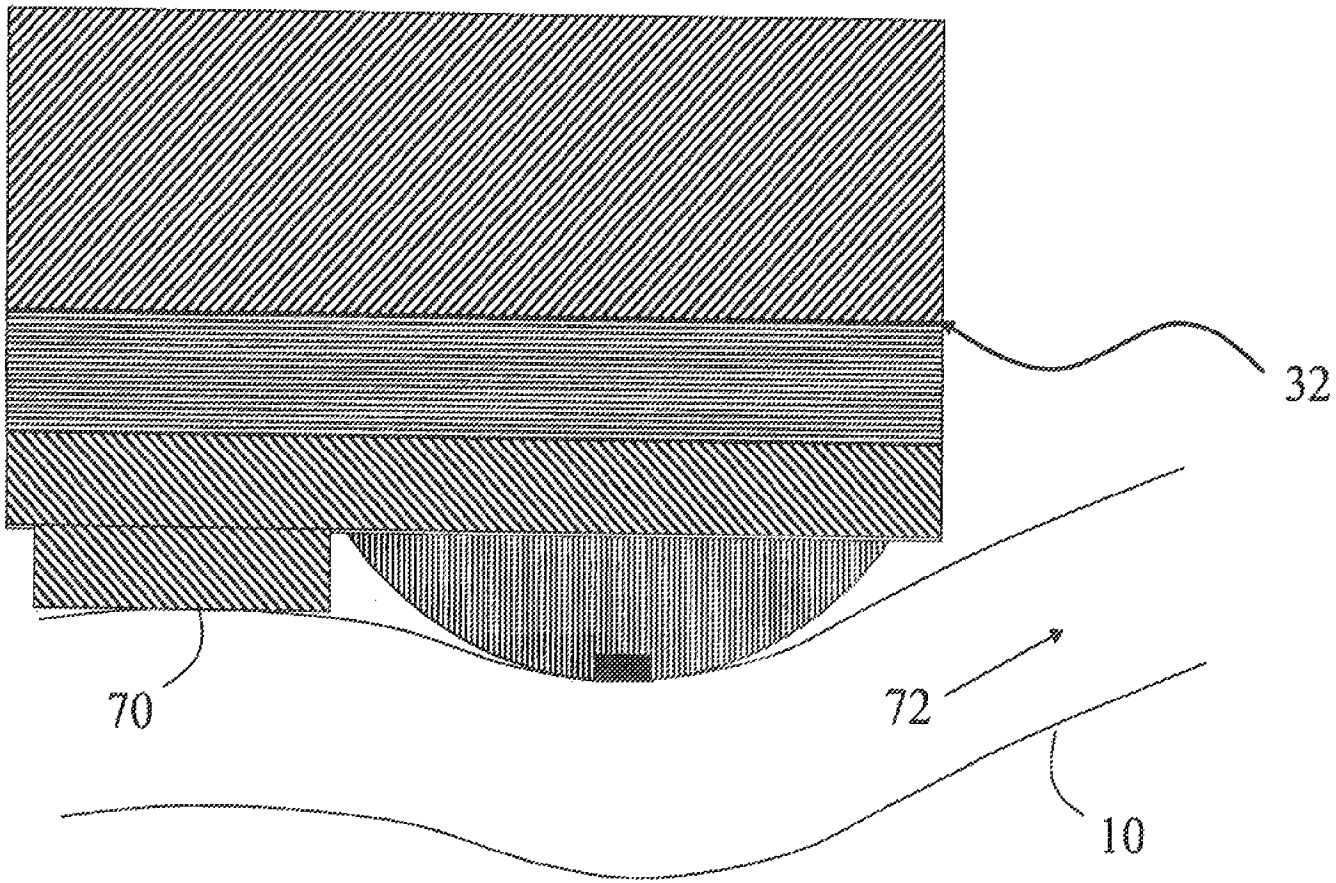
FIG. 6 is a schematic, side sectional view of a preheating element in conjunction with a thermal printing head in contact with a multicolor thermal imaging member.

Other techniques may be used to adjust the baseline temperature of the image-forming layers of the thermal imaging member during image formation: FIG. 6 shows an example of one such way to accomplish this result. Referring now to FIG. 6, there is seen preheating element 70 that is arranged to contact and heat the thermal imaging member 10 prior to its encounter with the resistors of the printing head. Arrow 72 indicates the direction of motion of the thermal imaging member. Forming an image in image-forming layer 18 is carried out when that layer is at baseline temperature $T_2$ as defined above. Preheating element 70 is therefore in place during the printing pass in which image-forming layer 18 undergoes image formation. Image-forming layers 14 and 16 are imaged while image-forming layer 18 is at baseline temperature $T_1$ without preheating element 70 in place. In cases where more than one printing head is used, one printing head may be equipped with preheating element 70, and used to form an image in image-forming layer 18, while another printing head, without a preheating element, can be used to form an image in image-forming layers 14 and 16. These thermal printing heads could print in either order, but it is preferred that the thermal printing head without preheating encounter the thermal imaging member first. Where a single printing head is employed, preheating element 70 can be moved so as not to contact thermal imaging member 10 during the printing pass in which image-forming layers 14 and 16 are imaged. Alternatively, an imaging member can be translated in the opposite direction to that shown by the arrow 72, so that preheating element 70 comes into contact with the thermal imaging member only after printing has taken place.

Any suitable heat-providing member may be used to preheat the thermal imaging member according to the method of the invention. The preheating element may be a thermally conductive shim that is in thermal contact with the heat sink of a thermal printing head and provides additional area of contact with a thermal imaging member. In some cases, this shim may also serve as the cover for the integrated circuits that supply current to the resistors of the thermal printing head, or it may be part of the heat sink of the thermal printing head. Alternatively, the preheating element may include a separate resistive heater, a conduit for a heating fluid, or other heating means such as are well known to those of ordinary skill in the art:

Although FIG. 6 shows preheating of the same surface of the imaging member that is addressed by the thermal printing head, it will be appreciated that the imaging member could be preheated from the surface opposed to that which is addressed by the thermal printing head. Preheating of both surfaces of the imaging member is also possible.

Whether or not the baseline temperatures of the image-forming layers of the imaging member are significantly altered by contact with the preheating element depends upon how long the member is in contact with the preheating element, and this depends upon the length of contact between them in the direction of transport of the thermal imaging member 10 and the speed of transport.

As mentioned above, in one preferred embodiment of the present invention, image-forming layers 14 and 16 are imaged in one printing pass while image-forming layer 18 is at a baseline temperature $T_1$ that is substantially equal to ambient temperature, while image-forming layer 18 is imaged in a second printing pass while it is at a baseline temperature $T_2$ that is substantially above ambient temperature. If contact with a preheating element is used to adjust the baseline temperature of image-forming layer 18, and the two printing passes are of the same speed, then the temperature of the preheating element, or the length of contact between the imaging member and the preheating element, must be adjusted between the two printing passes. In practice, difficulties may be encountered in achieving this result. Where, however, the two printing passes are not carried out at the same speed, it may not be necessary to adjust the temperature of the preheating element or the length of contact between it and the imaging member. This is because the first printing pass can be at a high speed such that there is not sufficient time for the imaging medium to equilibrate to the temperature of the preheating element to a depth that substantially includes image-forming layer 18, in which case the baseline temperature of this layer remains substantially equal to $T_1$, while the second printing pass can be at a slower speed that allows time for heating of image-forming layer 18 to a baseline temperature that is substantially equal to $T_2$.

In a particularly preferred embodiment, the preheating element is above $T_1$ and the thermal imaging medium makes contact with the preheating element over a length in the transport direction of at least about 200 microns. In embodiments of the present invention where at least one of the multiple passes of a thermal printing head is carried out at a different speed than that of at least one of the other passes, for example, where a printing pass in which image-forming layers 14 and 16 are imaged in a first pass and image-forming layer 18 is imaged in a second pass, the first pass is preferably carried out at or above a speed of about 0.8 inch/second, and especially preferably at or above a speed of about 1 inch/second, and the second printing pass in which image-forming layer 18 is imaged is preferably carried out at or below a speed of about 0.5 inches/second, and especially preferably at or below a speed of about 0.3 inches/second.

In another particularly preferred embodiment of the method of the invention, the preheating element is above ambient temperature, the thermal imaging member makes contact with the preheating element over a length in the transport direction of at least about 200 microns, and three printing passes are employed. The printing pass or passes in which image-forming layer 14 is imaged is carried out at or above a speed of about 0.8 inch/second, and especially preferably at or above a speed of about 1 inch/second, the printing pass or passes in which image-forming layer 16 is imaged is carried out at or above a speed of about 0.8 inch/second, and especially preferably at or above a speed of about 1 inch/second, and the printing pass or passes in which image-forming layer 18 is imaged is carried out at or below a speed of about 0.5 inches/second, and especially preferably at or below a speed of about 0.3 inches/second.

Figure 7:
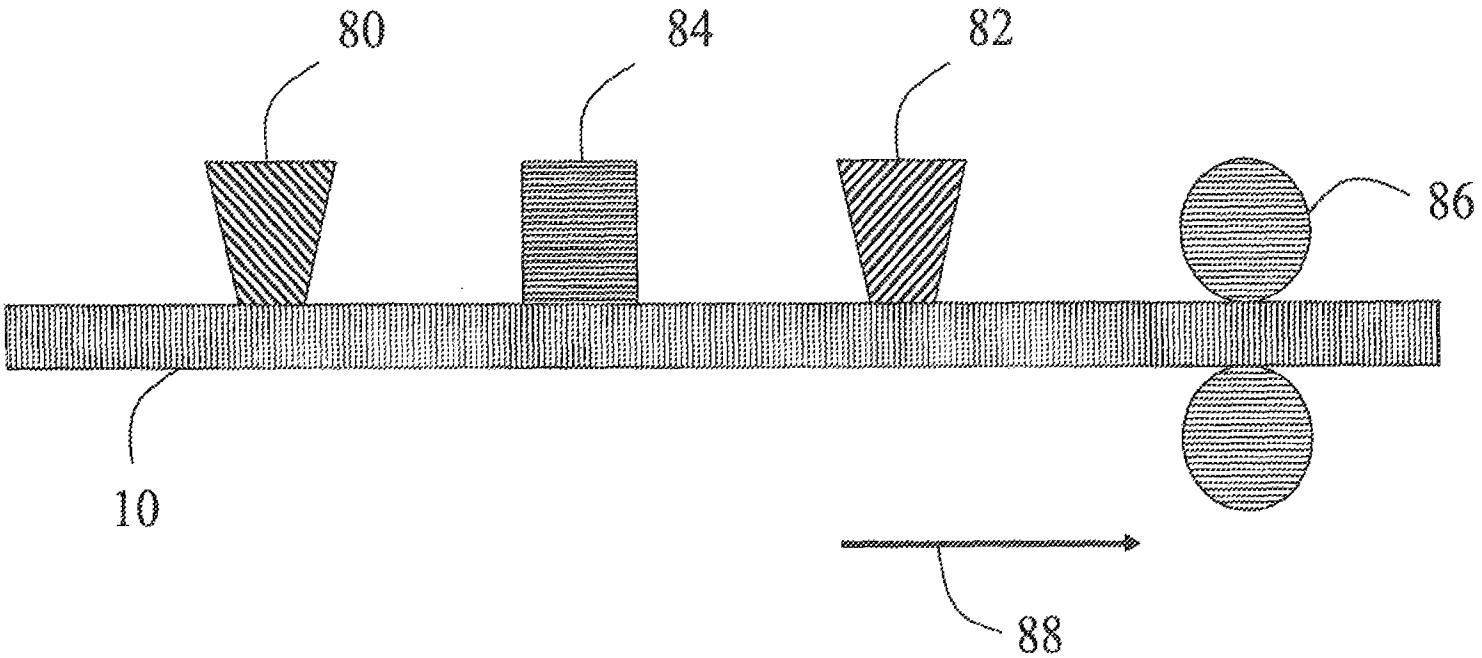
FIG. 7 is a schematic view of a thermal printer of the present invention.

In yet another preferred embodiment of the invention, there is provided a printer comprising two thermal printing heads 80 and 82 that address the same surface of the imaging member 10, as is shown in FIG. 7. Each printing head 80 and 82 comprise a substantially linear array of heating elements that extend across the thermal imaging member 10 in a direction perpendicular to the direction of transport. Preferably between the heating elements of printing heads 80 and 82 are provided means 84 for preheating of the thermal imaging member. The thermal imaging member 10 is transported past the printing heads and preheating means in the direction of arrow 86 by transporting means 88. The transporting means can be a nip roller, or alternatively a platen roller or rollers opposing one or both of the thermal printing heads. Other transporting means will be familiar to those of skill in the art.

As described above, preheating means 84 can be any means that would be apparent to one of skill in the art (contact heating, irradiation, hot air, etc.). Preheating means 84 may, as described above, be the printing head glaze of one or both of the thermal printing heads. The temperature of the printing head glaze may be adjusted, as is also described above, by heating or cooling the heat sink of the thermal printing head.

In one preferred embodiment, printing head 80 is used to address image-forming layers 14 and 16 of imaging member 10 while image-forming layer 18 is at a relatively low baseline temperature, following which preheating means 84 is used to raise the baseline temperature of image-forming layer 18. After preheating, printing head 82 is used to form an image in image-forming layer 18. It will be apparent to one of skill in the art that other combinations for layer addressing are possible. In particular, it is possible that image-forming layer 14 be addressed by either or both of thermal printing heads 80 and 82. It is also possible that a third printing head be provided, possibly separated from printing head 82 by a second preheating means.

It is not necessary that thermal printing heads 80 and 82 have the same design. The present inventors have found that the ideal resistor shape for addressing image-forming layers close to the surface of the thermal imaging member (such as image-forming layer 14) is not the same as the ideal resistor shape for addressing more deeply buried layers (such as image-forming layer 18). In particular, resistors with shorter length in the transport direction of the thermal imaging member are preferred for image-forming layers closer to the surface of the thermal imaging member. For example, image-forming layer 14 may be addressed by heating elements about 90 microns in length, while image-forming layer 18 might be addressed by heating elements 180 microns in length, such lengths measured in the transport direction of the thermal imaging member. Differences in length of the heating elements of as little as about 5 microns may be significant. In addition, the thickness of the printing head glaze on which the resistors are located is ideally thinner for printing image-forming layers closer to the surface of the thermal imaging member than for printing the more deeply buried layers. For example, image-forming layer 14 may be addressed by a thermal printing head having glaze thickness as low as about 70 microns, while image-forming layer 18 might be addressed by a thermal printing head having a glaze thickness as great as about 200 microns or more. Differences in glaze thickness of as little as about 5 microns may be significant.

There is also no need for each thermal printing head to have the same number of resistors per unit length. As described, for example, in U.S. Pat. No. 6,906,736, it may be preferred that each thermal printing head have a different number of resistors per unit length.

When preheating means 84 is the printing head glaze of thermal printing head 82, it is preferred that thermal printing head 82 be maintained at a different (preferably higher) temperature than thermal printing head 80 during printing of thermal imaging member 10.

Although preheating means 84 has been described as providing additional heat to imaging member 10, it will be clear that 84 might alternatively be a cooling means, in which case thermal printing head 80 could, for example, be used to form an image in image-forming layer 18, following which its baseline temperature could be lowered and thermal printing head 82 could be used to form an image in image-forming layers 14 and 16. Other combinations will occur to one of skill in the art.

It will be obvious that the reverse side of the substrate 12 of imaging member 10 could be coated with image-forming layers that could be addressed either by thermal printing heads 80 and 82 (after inversion of the thermal imaging member) or by additional thermal printing heads (in which case addressing of both sides of the thermal imaging member could be simultaneous).

Although the thermal printer illustrated in FIG. 7 has been described with reference to thermal printing heads, it will be clear to one of skill in the art that 80 and 82 could be any modulated or unmodulated heating means whatsoever that might form an image in thermal imaging member 10. For example, 80 and 82 could be hot stamps or sources of controlled irradiation such as lasers or laser arrays. As described above, it is well known in the art that if a source of light is used for heating, an absorber for the light must be incorporated into the thermal imaging member. As described for example in U.S. Pat. No. 5,627,014 such absorbers need not be visible if the radiation to be absorbed falls outside the visible range, for example, in the ultraviolet or the infrared regions of the electromagnetic spectrum.

In the practice of the present invention, it may be necessary that the printing pulses supplied by the thermal printing head (or other heating means) be adjusted so as to compensate for the residual heat in the printing head itself and in the thermal imaging member that results from the printing of preceding (and neighboring) pixels in the image. Such thermal history compensation may be carried out as described in U.S. Pat. No. 6,819,347 B2.

As described above herein, the method of the present invention can provide independent formation of each color, e.g., cyan, magenta or yellow. Thus, in this embodiment, one combination of temperature and time will permit the selection of any density of one color while not producing any noticeable amount of the other colors. Another combination of temperature and time will permit the selection of another of the three colors, and so forth. A juxtaposition of temperature-time combinations will allow the selection of any combination of the three subtractive primary colors in any relative amounts.

In other embodiments of the invention, thermal addressing of the image-forming layers, rather than being completely independent, may be substantially independent or only partially independent. Various considerations, including material properties, printing speed, energy consumption, material costs and other system requirements may dictate a system with increased lack of addressing independence, the consequence of which is color "cross-talk", i.e., the contamination of an intended color by another color. While independent or substantially independent color addressing according to the invention is important for imaging of photographic quality, this requirement may be of less importance in the formation of certain images such as, for example, labels or coupons, and in these cases may be sacrificed for economic considerations such as improved printing speed or lower costs.

In the embodiments of the invention where addressing of the separate image-forming layers of a multicolor thermal imaging member is not completely, but rather only substantially or partially independent, and by design the printing of the first color may produce a certain amount of a second color, the color gamut of the imaging member will be reduced. Since, as described above, the color gamut of the imaging member will be affected by the conditions of imaging, these conditions may be selected so as to optimize the overall system for its intended application with respect to color gamut, speed, cost, etc.

A number of image-forming techniques may be exploited in accordance with the invention including thermal diffusion with buried layers (as described in detail above), chemical diffusion or dissolution in conjunction with timing layers, melting transitions and chemical thresholds. Many such image-forming techniques have been described in detail in U.S. Pat. No. 6,801,233 B2. All such image-forming techniques may be exploited in the imaging members utilized in the method of the invention.

It should be noted here that the image-forming layers of the imaging members utilized in the method of the invention may themselves comprise two or more separate layers or phases. For example, where the image-forming material is a leuco dye that is used in conjunction with a developer material, the leuco dye and the developer material may be disposed in separate layers.

The image-forming layers of an imaging member utilized according to the invention may optionally undergo more than one color change. For example, image-forming layer 14 of imaging member 10 (FIG. 1) may go from colorless to yellow to red as a function of the amount of heat applied. Likewise, image-forming layers could start in the colored form, and be decolorized by heating. Those skilled in the art will realize that such color changes can be obtained by exploiting the imaging mechanism described in U.S. Pat. No. 3,895,173.

Any combination of materials that may be thermally induced to change color may be used in the image-forming layers. The materials may react chemically under the influence of heat, either as a result of being brought together by a physical mechanism, such as melting, or through thermal acceleration of a reaction rate. The reaction may be chemically reversible or irreversible.

The substrate for the thermal imaging member, e.g., substrate 12, may be of any suitable material for use in thermal imaging members, such as polymeric materials or treated papers, and may be transparent or reflective. The substrate may also carry layers such as adhesion-promoting layers, antistatic layers, or gas barrier layers. The face of substrate 12 opposite to that onto which is coated image-forming layer 18 may bear indicia such as a logo, or may comprise an adhesive composition such as a pressure-sensitive adhesive. Such an adhesive may be protected by a peelable liner layer. The substrate 12 may be of any practical thickness, depending upon the application, ranging from about 2 micrometers in thickness to card stock of about 500 micrometers in thickness or more.

In a preferred embodiment, at least one, and preferably all of the image-forming layers include as an image-providing material a chemical compound in a crystalline form, the crystalline form being capable of being converted to a liquid in the amorphous form, where the amorphous form of the chemical compound intrinsically has a different color from the crystalline form. A color thermal imaging method and thermal imaging member wherein at least one image-forming layer includes such a chemical compound are described and claimed in commonly assigned U.S. patent application Ser. No. 10/789,648, filed Feb. 27, 2004, (United States Patent Application Publication No. US2004/0176248 A1).

The image-forming layers of the imaging members used according to the method of the invention, e.g., image-forming layers 14, 16 and 18 of imaging member 10, may comprise any of the image-forming materials described above, or any other thermally-activated colorants, and are typically from about 0.5 to about 4 micrometers in thickness, preferably about 2 micrometers. In the case where the image-forming layers comprise more than one layer, as described above, each of the constituent layers is typically from about 0.1 to about 3 micrometers in thickness. The image-forming layers may comprise dispersions of solid materials, encapsulated liquids, amorphous or solid materials or solutions of active materials in polymeric binders, or any combinations of the above.

The distance from the outer surface of the outer layer of the imaging member, e.g., overcoat layer 24, to the interface between the first image-forming layer, e.g., image-forming layer 14, and a spacer layer, e.g., layer 20, is preferably between about 2 and 5 micrometers; the distance from the outer surface of the imaging member to the interface between a second image-forming layer, e.g., image-forming layer 16 and a spacer layer, e.g., spacer layer 22, is preferably between about 7 and about 12 micrometers, and the distance between the outer surface of the imaging member and the interface between the third image-forming layer, e.g., image-forming layer 18 and a substrate, e.g., substrate 12 is preferably at least about 28 micrometers.

Spacer layers, such as spacer layers 20 and 22, function as thermally insulating layers, and may comprise any suitable material. Typical suitable materials include water-soluble polymers such as poly(vinyl alcohol) or waterborne latex materials such as acrylates or polyurethanes. In addition, spacer layers 20 and 22 may comprise inorganic fillers such as for example calcium carbonate, calcium sulfate, silica or barium sulfate; ultraviolet absorbers such as zinc oxide, titanium dioxide, or organic materials such as benzotriazoles; materials that change phase such as organic crystalline compounds; and so on. In some embodiments, spacer layers may be solvent-soluble polymers such as for example poly(ethyl methacrylate). As mentioned above, if two spacer layers in an imaging member, e.g., spacer layers 20 and 22 comprise materials of substantially the same thermal diffusivity, preferably the spacer layer closer to the surface of the imaging member which is contacted by the thermal printing head, e.g., spacer layer 20, is thinner than the spacer layer remote from the contact surface, e.g., spacer layer 22. In a preferred embodiment, the thinner spacer layer is about 3.5-4 micrometers thick, and the thicker spacer layer is about 18-20 micrometers thick.

Spacer layers may be coated from water or an organic solvent, or may be applied as a laminated film. They may be opaque or transparent. In cases where one of the spacer layers, e.g., layers 20 and 22, is opaque, the substrate, e.g., substrate 12, is preferably transparent. In a preferred embodiment, the substrate is opaque and both spacer layers are transparent.

The thermal imaging members utilized in the method of the invention may also comprise an overcoat layer. The overcoat layer may comprise more than one layer. The function of the overcoat includes providing a thermally-resistant surface that is in contact with the thermal printing head, providing gas barrier properties and ultraviolet absorption to protect the image, and providing a suitable surface (for example, matte or glossy) for the surface of the image. Preferably, the overcoat layer is not more than 2 micrometers in thickness.

In an alternative embodiment of the invention, rather than coating overcoat 24, image-forming layer 14 is coated onto a thin substrate such as poly(ethylene terephthalate) of less than about 4.5 micrometers in thickness. This may be laminated onto the remaining layers of the imaging member. Any combination of coating and lamination may be used to build up the structure of imaging member 10.

A particularly preferred thermal imaging member according to the present invention is constructed as follows.

The substrate is a filled, white poly(ethylene terephthalate) base of thickness about 75 microns, Melinex 339, available from Dupont Teijin Films, Hopewell, Va.

A first layer deposited on the substrate is an optional oxygen barrier layer composed of a fully hydrolyzed poly(vinyl alcohol), for example, Celvol 325, available from Celanese, Dallas, Tex. (96.7% by weight), glyoxal (a crosslinker, 3% by weight) and Zonyl FSN (a coating aid, available from Dupont, Wilmington, Del., 0.3% by weight). This layer, when present, has a coverage of about 1.0 g/m$^2$.

Deposited either directly onto the substrate, or onto the optional oxygen barrier layer, is a cyan image-forming layer composed of a cyan color-former having melting point 210° C., of the type disclosed in the aforementioned U.S. Pat. No. 7,008,759 (1 part by weight), diphenyl sulfone (a thermal solvent having melting point 125° C., coated as an aqueous dispersion of crystals having average particle size under 1 micron, 3.4 parts by weight), Lowinox WSP (a phenolic antioxidant, available from Great Lakes Chemical Co., West Lafayette, Ind., coated as an aqueous dispersion of crystals having average particle size under 1 micron, 0.75 parts by weight), Chinox 1790 (a second phenolic antioxidant, available from Chitec Chemical, Taiwan, coated as an aqueous dispersion of crystals having average particle size under 1 micron, 1 part by weight), polyvinyl alcohol) (a binder, Celvol 205, available from Celanese, Dallas, Tex., 2.7 parts by weight), glyoxal (0.08.4 parts by weight) and Zonyl FSN (0.048 parts by weight). This layer has a coverage of about 2.5 g/m$^2$.

Deposited onto the cyan color-forming layer is a barrier layer that contains a fluorescent brightener. This layer is composed of a fully hydrolyzed poly(vinyl alcohol), for example, the above-mentioned Celvol 325, available from Celanese, Dallas, Tex. (3.75 parts by weight), glyoxal (0.08 parts by weight), Leucophor BCF P115 (a fluorescent brightener, available from Clariant Corp., Charlotte, N.C., 0.5 parts by weight), boric acid (0.38 parts by weight) and Zonyl FSN (0.05 parts by weight). This layer has a coverage of about 1.5 g/m$^2$.

Deposited on the barrier layer is a thermally-insulating interlayer composed of Glascol C-44 (a latex available from Ciba Specialty Chemicals Corporation, Tarrytown, N.Y., 18 parts by weight), Joncryl 1601 (a latex available from Johnson Polymer, Sturtevant, Wis., 12 parts by weight) and Zonyl FSN (0.02 parts by weight). This layer has a coverage of about 13 g/m$^2$.

Deposited on the thermally-insulating interlayer is a barrier layer composed of a fully hydrolyzed poly(vinyl alcohol), for example, the above-mentioned Celvol 325, available from Celanese, Dallas, Tex. (2.47 parts by weight), glyoxal (0.07 parts by weight), boric acid (0.25 parts by weight) and Zonyl FSN (0.06 parts by weight). This layer has a coverage of about 1.0 g/m$^2$.

Deposited on the barrier layer is a magenta color-forming layer, composed of a magenta color-former having melting point 155° C., of the type disclosed in U.S. patent application Ser. No. 10/788,963, filed Feb. 27, 2004, United States Patent Application Publication No. US2004/0191668 A1 (1.19 parts by weight); a phenolic antioxidant (Anox 29, having melting point 161-164° C., available from Great Lakes Chemical Co., West Lafayette, Ind., coated as an aqueous dispersion of crystals having average particle size under 1 micron, 3.58 parts by weight), Lowinox CA22 (a second phenolic antioxidant, available from Great Lakes Chemical Co., West Lafayette, Ind., coated as an aqueous dispersion of crystals having average particle size under 1 micron, 0.72 parts by weight), poly(vinyl alcohol) (a binder, Celvol 205, available from Celanese, Dallas, Tex., 2 parts by weight), the potassium salt of Carboset 325 (an acrylic copolymer, available from Noveon, Cleveland, Ohio, 1 part by weight) glyoxal (0.06 parts by weight) and Zonyl FSN (0.06 parts by weight). This layer has a coverage of about 2.7 g/m$^2$.

Deposited on the magenta color-forming layer is a barrier layer composed of a fully hydrolyzed poly(vinyl alcohol), for example, the above-mentioned Celvol 325, available from Celanese, Dallas, Tex. (2.47 parts by weight), glyoxal (0.07 parts by weight), boric acid (0.25 parts by weight) and Zonyl FSN (0.06 parts by weight). This layer has a coverage of about 1.0 g/m$^2$.

Deposited on the barrier layer is a second thermally-insulating interlayer composed of Glascol C-44 (1 part by weight), Joncryl 1601 (a latex available from Johnson Polymer, 0.67 parts by weight) and Zonyl FSN (0.004 parts by weight). This layer has a coverage of about 2.5 g/m$^2$.

Deposited on the second interlayer is a yellow color-forming layer composed of Dye XI (having melting point 202-203° C.) described in U.S. patent application Ser. No. 10/789,566, filed Feb. 27, 2004, United States Patent Application Publication No. US2004/0204317 A1 (4.57 parts by weight), polyvinyl alcohol) (a binder, Celvol 540, available from Celanese, Dallas, Tex., 1.98 parts by weight), a colloidal silica (Snowtex 0-40, available from Nissan Chemical Industries, Ltd Tokoyo, Japan, 0.1 parts by weight), glyoxal (0.06 parts by weight) and Zonyl FSN (0.017 parts by weight). This layer has a coverage of about 1.6 g/m$^2$.

Deposited on the yellow color-forming layer is a barrier layer composed of a fully hydrolyzed poly(vinyl alcohol), for example, the above-mentioned Celvol 325, available from Celanese, Dallas, Tex. (1 part by weight), glyoxal (0.03 parts by weight), boric acid (0.1 parts by weight) and Zonyl FSN (0.037 parts by weight). This layer has a coverage of about 0.5 g/m$^2$.

Deposited on the barrier layer is an ultra-violet blocking layer composed of a nanoparticulate grade of titanium dioxide (MS-7, available from Kobo Products Inc., South Plainfield, N.J., 1 part by weight), poly(vinyl alcohol) (a binder, Elvanol 40-16, available from DuPont, Wilmington, Del., 0.4 parts by weight), Curesan 199 (a crosslinker, available from BASF Corp., Appleton, Wis., 0.16 parts by weight) and Zonyl FSN (0.027 parts by weight). This layer MB a coverage of about 1.56 g/m$^2$.

Deposited on the ultra-violet blocking layer is an overcoat composed of a latex (XK-101, available from NeoResins, Inc., Wilmingtom, Mass., 1 part by weight), a styrene/maleic acid copolymer (SMA 17352H, available from Sartomer Company, Wilmington, Pa., 0.17 parts by weight), a crosslinker (Bayhydur VPLS 2336, available from BayerMaterialScience, Pittsburgh, Pa., 1 part by weight), zinc stearate (Hidorin F-115P, available from Cytech Products Inc., Elizabethtown, Ky., 0.66 parts by weight) and Zonyl FSN (0.04 parts by weight). This layer has a coverage of about 0.75 g/m$^2$.

Optimal conditions for printing a yellow image using the preferred thermal imaging member described above are as follows. Thermal printing head parameters:

Pixels per inch: 300
Resistor size: 2×(31.5×120) microns
Resistance: 3000 Ohm
Glaze Thickness: 110 microns
Pressure: 3 lb/linear inch
Dot pattern: Slanted grid.

The yellow color-forming layer is printed as shown in the table below. The line cycle time is divided into individual pulses of 75% duty cycle. The thermal imaging member is preheated by contact with the thermal printing head glaze at the heat sink temperature over a distance of about 0.3 mm.

| | Yellow printing |
|---|---|
| Heat sink temperature | 25° C. |
| Dpi (transport direction) | 300 |
| Voltage | 38 |
| Line speed | 6 inch/sec |
| Pulse interval | 12.5 microsec |
| # pulses used | 8-17 |

Optimal conditions for printing a magenta image using the preferred thermal imaging member described above are as follows. Thermal printing head parameters:

Pixels per inch: 300
Resistor size: 2×(31.5×120) microns
Resistance: 3000 Ohm
Glaze Thickness: 200 microns
Pressure: 3 lb/linear inch
Dot pattern: Slanted grid.

The magenta color-forming layer is printed as shown in the table below. The line cycle time is divided into individual pulses of 7.14% duty cycle. The thermal imaging member is preheated by contact with the thermal printing head glaze at the heat sink temperature over a distance of about 0.3 mm.

| | Magenta printing |
|---|---|
| Heat sink temperature | 30° C. |
| Dpi (transport direction) | 300 |

-continued

| | Magenta printing |
|---|---|
| Voltage | 38 |
| Line speed | 0.75 inch/sec |
| Pulse interval | 131 microsec |
| # pulses used | 20-30 |

Optimal conditions for printing a cyan image using the preferred thermal imaging member described above are as follows. Thermal printing head parameters:

Pixels per inch: 300
Resistor size: 2×(31.5×180) microns
Resistance: 3000 Ohm
Glaze Thickness: 200 microns
Pressure: 3 lb/linear inch
Dot pattern: Slanted grid.

The cyan color-forming layer is printed as shown in the table below. The line cycle time is divided into individual pulses of about 4.5% duty cycle. The thermal imaging member is preheated by contact with the thermal printing head glaze at the heat sink temperature over a distance of about 0.3 mm.

| | Cyan printing |
|---|---|
| Heat sink temperature | 50° C. |
| Dpi (transport direction) | 300 |
| Voltage | 38 |
| Line speed | 0.2 inch/sec |
| Pulse interval | 280 microsec |
| # pulses used | 33-42 |

EXAMPLES

The invention will now be further illustrated with respect to specific preferred embodiments by way of examples, it being understood that these are intended to be illustrative only and the invention is not limited to the materials, imaging members, imaging methods, etc. described therein. All parts and percentages recited are by weight unless otherwise specified.

The thermal imaging member used in all the Examples below was prepared as follows.

The following materials were used in preparation of the thermal imaging member:

Celvol 205, a grade of poly(vinyl alcohol) available from Celanese, Dallas, Tex.;

Celvol 325, a grade of poly(vinyl alcohol) available from Celanese, Dallas, Tex.;

Celvol 540, a grade of poly(vinyl alcohol) available from Celanese, Dallas, Tex.;

NeoCryl A-639, available from NeoResins, Inc., Wilmingtom, Mass.;

Glascol TA, a polyacrylamide available from Ciba Specialty Chemicals Corporation, Tarrytown, N.Y.;

Zonyl FSN, a surfactant, available from DuPont Corporation, Wilmington, Del.;

Pluronic 25R4, a surfactant available from BASF, Florham Park, N.J;

Surfynol CT-111, a surfactant available from Air Products and Chemicals, Inc., Allentown, Pa.;

Surfynol CT-131, a surfactant available from Air Products and Chemicals, Inc., Allentown, Pa.;

Tamol 731, a surfactant available from ROHM and HAAS Co. Philadelphia, Pa.;

Triton X-100, a surfactant available from The Dow Chemical Company, Midland, Mich.;

Hidorin F-115P, a grade of zinc stearate available from Cytech Products Inc., Elizabethtown, Ky.;

Nalco 30V-25, a silica dispersion available from ONDEO Nalco Company, Chicago, Ill.;

RPVC 0.008, a white rigid poly(vinyl chloride) film base of approximately 8 mils in thickness, available from Tekra Corporation, New Berlin, Wis.;

Yellow Color Former: Dye IV (having melting point 105-107° C.) described in U.S. patent application Ser. No. 10/789,566, filed Feb. 27, 2004, United States Patent Application Publication No. US2004/0204317 A1;

Magenta Color Former: a color-former having melting point 155° C., of the type disclosed in U.S. patent application Ser. No. 10/788,963, filed Feb. 27, 2004, United States Patent Application Publication No. US2004/0191668 A1; a thermal solvent, Anox 29, having melting point 161-164° C., available from Great Lakes Chemical Co., West Lafayette, Ind., was used in conjunction with the magenta color former.

Cyan Color Former: a color-former having melting point 210° C., of the type disclosed in the aforementioned U.S. patent application Ser. No. 10/788,963.

The imaging member was prepared by successive coatings applied to the substrate, which was RPVC 0.008.

A yellow image-forming layer was applied as follows:

Yellow Color Former (10 g) was dispersed in a mixture comprising Celvol 205 (6.3 g of a 17.6% solution in water), methyl acetate (4 g) and water (43.7 g), using an attritor equipped with glass beads, stirred for 24 hours at room temperature. The total solid content of the resulting dispersion was 18%.

The above dispersion was combined with water and the materials listed in the table below to make the coating fluid for the yellow dye-forming layer in proportions stated. The coating composition thus prepared was coated onto RPVC 0.008 for a dried thickness of 1.9 microns.

| Ingredient | % solids in coating fluid |
|---|---|
| Yellow Color Former dispersion solids | 5.33 |
| Celvol 205 | 0.27 |
| Zinc sulfate | 2.65 |
| Zonyl FSN | 0.09 |

An interlayer was next applied as follows:

Water was combined with the materials listed in the table below to provide a coating fluid, which was coated onto the yellow image-forming layer for a dried thickness of 18 microns.

| Ingredient | % solids in coating fluid |
|---|---|
| NeoCryl A-639 | 6.27 |
| Celvol 325 | 4.68 |
| Zonyl FSN | 0.09 |

A magenta image-forming layer was applied as follows:

Magenta Color Former (587.50 g) was dispersed in a mixture comprising Surfynol CT-111 (26.88 g of a 83% solution in water), Surfynol CT-131 (20.43 g of a 52% solution in water), methyl acetate (375 g) and water (1490.19 g), using an attritor equipped with glass beads, stirred for 21.5 hours at room temperature. The total solid content of the resulting dispersion was 14.03%.

The thermal solvent (510 g) having melting point 165° C. was dispersed in a mixture comprising Tamol 731 (437.32 g of a 6.86% solution in water, adjusted with sulfuric acid to a pH of 6.7-6.8), Celvol 205 (340.91 g of a 17.6% solution in water), and water (711.77 g), using an attritor equipped with glass beads, stirred for 18.5 hours at room temperature. The total solid content of the resulting dispersion was 23.29%.

The above dispersions were combined with water and the materials listed in the table below to make the coating fluid for the magenta dye-forming layer in proportions stated. The coating composition thus prepared was coated onto the interlayer prepared as described above for a dried thickness of 1.9 microns.

| Ingredient | % solids in coating fluid |
|---|---|
| Magenta Color Former dispersion solids | 1.67 |
| Thermal solvent dispersion solids | 5.07 |
| Celvol 205 | 1.67 |
| Zonyl FSN | 0.08 |

A Second interlayer was applied as follows:

Water was combined with the materials listed in the table below to provide a coating fluid, which was coated onto the magenta image-forming layer for a dried thickness of 3.5 microns.

| Ingredient | % solids in coating fluid |
|---|---|
| Copolymer of acrylate, styrene and acrylic acid | 7.29 |
| Celvol 540 | 0.55 |
| Glascol TA | 0.15 |
| Zonyl FSN | 0.06 |

A cyan image-forming layer was prepared as follows:

Cyan Color Former (705.0 g, melting point 207-210° C.) was dispersed in a mixture comprising Surfynol CT-131 (14.42 g of a 52% solution in water), Pluronic 25R4 (18.75 g of 100% active), Triton X-100 (18.75 g of 100% active) methyl acetate (437.5 g) and water (1312.5 g), using an attritor equipped with glass beads, stirred for 18.5 hours at room temperature. The total solid content of the resulting dispersion was 26.98%.

The above dispersion was combined with water and the materials listed in the table below to make the coating fluid for the cyan dye-forming layer in proportions stated. The coating composition thus prepared was coated onto the second interlayer prepared as above for a dried thickness of 2.0 microns.

| Ingredient | % solids in coating fluid |
|---|---|
| Cyan Color dispersion solids | 3.8 |

-continued

| Ingredient | % solids in coating fluid |
|---|---|
| Celvol 205 | 2.54 |
| Zonyl FSN | 0.08 |

An overcoat was applied as follows:

Water was combined with the materials listed in the table below to provide a coating fluid, which was coated onto the cyan image-forming layer for a dried thickness of 0.76 microns.

| Ingredient | % solids in coating fluid |
|---|---|
| Hidorin F-115P | 0.63 |
| Celvol 540 | 1.27 |
| Nalco 30V-25 | 1.04 |
| Zonyl FSN | 0.09 |

In Examples I and II below, the following printing parameters were used:

Printing head: Toshiba F3788B, available from Toshiba Hokuto Electronics Corporation Printing head width: 115 mm, 108.4 printing width Pixels per inch: 300

Resistor size: 2×(31.5×120) microns

Resistance: 1835 Ohm

Glaze Thickness: 65 microns

Pressure: 1.5-2 lb/linear inch

Dot pattern: Rectangular grid.

Example I

This Example illustrates, for comparative purposes, a method in which the thermal imaging member prepared as described above was imaged in three printing passes, each at the same speed, and each having the same amount of preheating.

All three colors were printed at a resolution in the direction of transport and a line cycle time as shown in the table below. The line cycle time was divided into individual pulses of 95% duty cycle. Each color was printed in a separate pass using the voltage and the number of pulses shown in the table. The thermal imaging member was preheated by contact with material at the heat sink temperature over a distance of about 0.3 mm. Ten areas of the imaging member were printed for each color, ranging from Dmin (using the lowest number of pulses in the indicated range) for Dmax (using the maximum number of pulses in the indicated range.

| | Cyan | Magenta | Yellow |
|---|---|---|---|
| Heat sink temperature | 49° C. | 49° C. | 49° C. |
| Dpi (transport direction) | 600 | 600 | 600 |
| Voltage | 32.5 | 13.74 | 8.75 |
| Line cycle time | 8 ms | 8 ms | 8 ms |
| # pulses/line | 715 | 715 | 715 |
| # pulses used | 19-39 | 206-274 | 550-715 |

Figure 8:
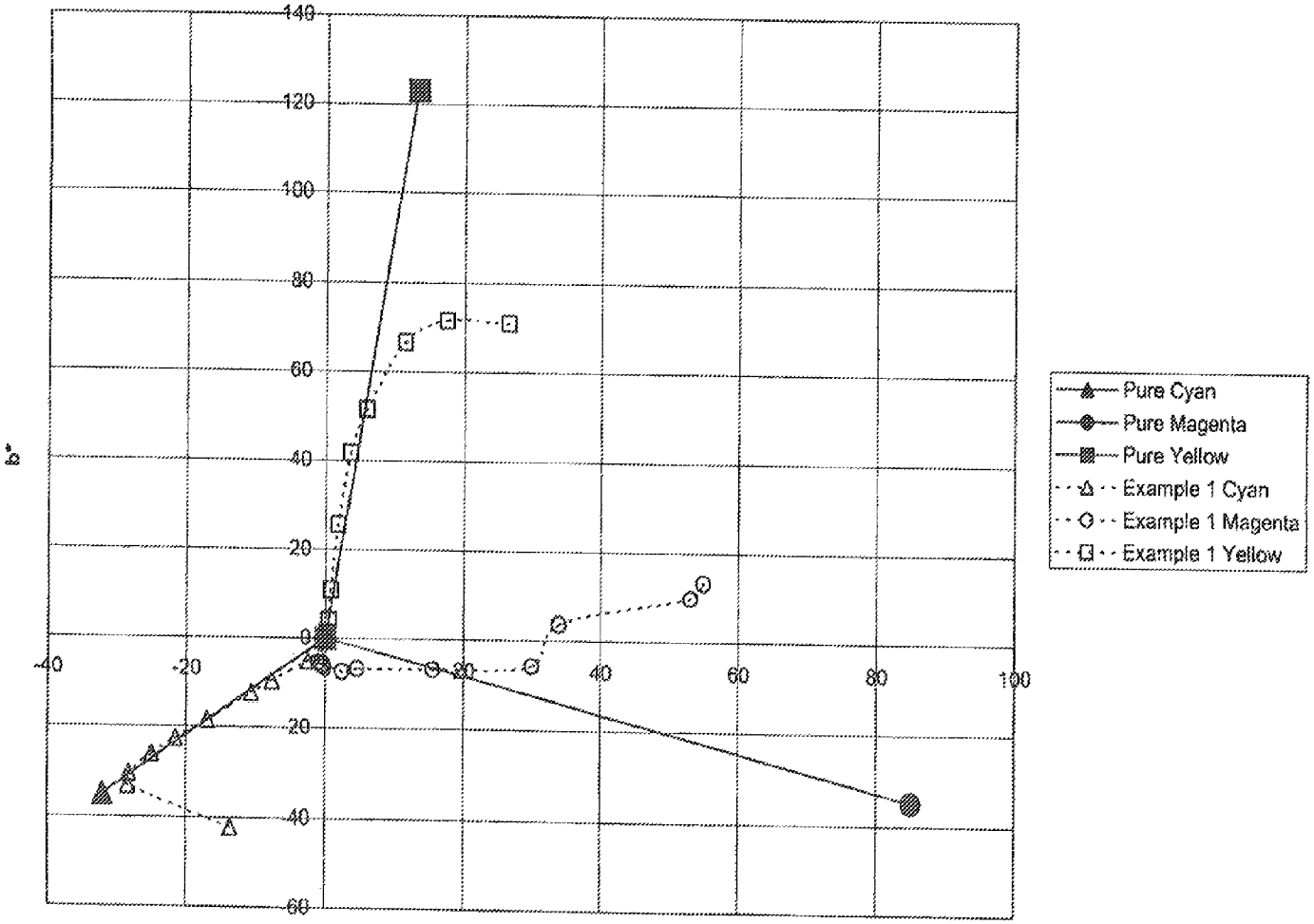
FIG. 8 is a chart showing the color gamut available with a multicolor thermal imaging method.

Each colored patch was measured using a Gretag SPM50 densitometer manufactured by Gretag Ltd., Switzerland. The measurement conditions were: illumination=D50; observer angle=2°; density standard=DIN; calibrated against white base, without filter. The CIELab colors associated with each patch are shown in FIG. 8, in which only a* and b* values are shown. Also shown in FIG. 8 are the a* and b* values of the pure color formers at a reflection optical density of approximately 2.0.

It can be seen from FIG. 8 that using the method of this example, all three subtractive primary colors may be printed onto the thermal imaging member.

Example II

This Example illustrates a method of the present invention, in which the thermal imaging member prepared as described above was imaged in three printing passes, each at the same speed, one of which had a different amount of preheating from the other two.

All three colors were printed in separate passes as indicated in the table below. The line cycle time was divided into individual pulses of 95% duty cycle. The thermal imaging member was preheated by contact with material at the heat sink temperature over a distance of about 0.3 mm. Ten areas of the imaging member were printed for each color, ranging from Dmin (using the lowest number of pulses in the indicated range) for Dmax (using the maximum number of pulses in the indicated range.

| | Cyan | Magenta | Yellow |
|---|---|---|---|
| Heat sink temperature | 26° C. | 26° C. | 49° C. |
| Dpi (transport direction) | 600 | 600 | 600 |
| Voltage | 34 | 15 | 8.8 |
| Line cycle time | 8 ms | 8 ms | 8 ms |
| # pulses/line | 715 | 715 | 715 |
| # pulses used | 18-38 | 200-280 | 550-715 |

Figure 9:
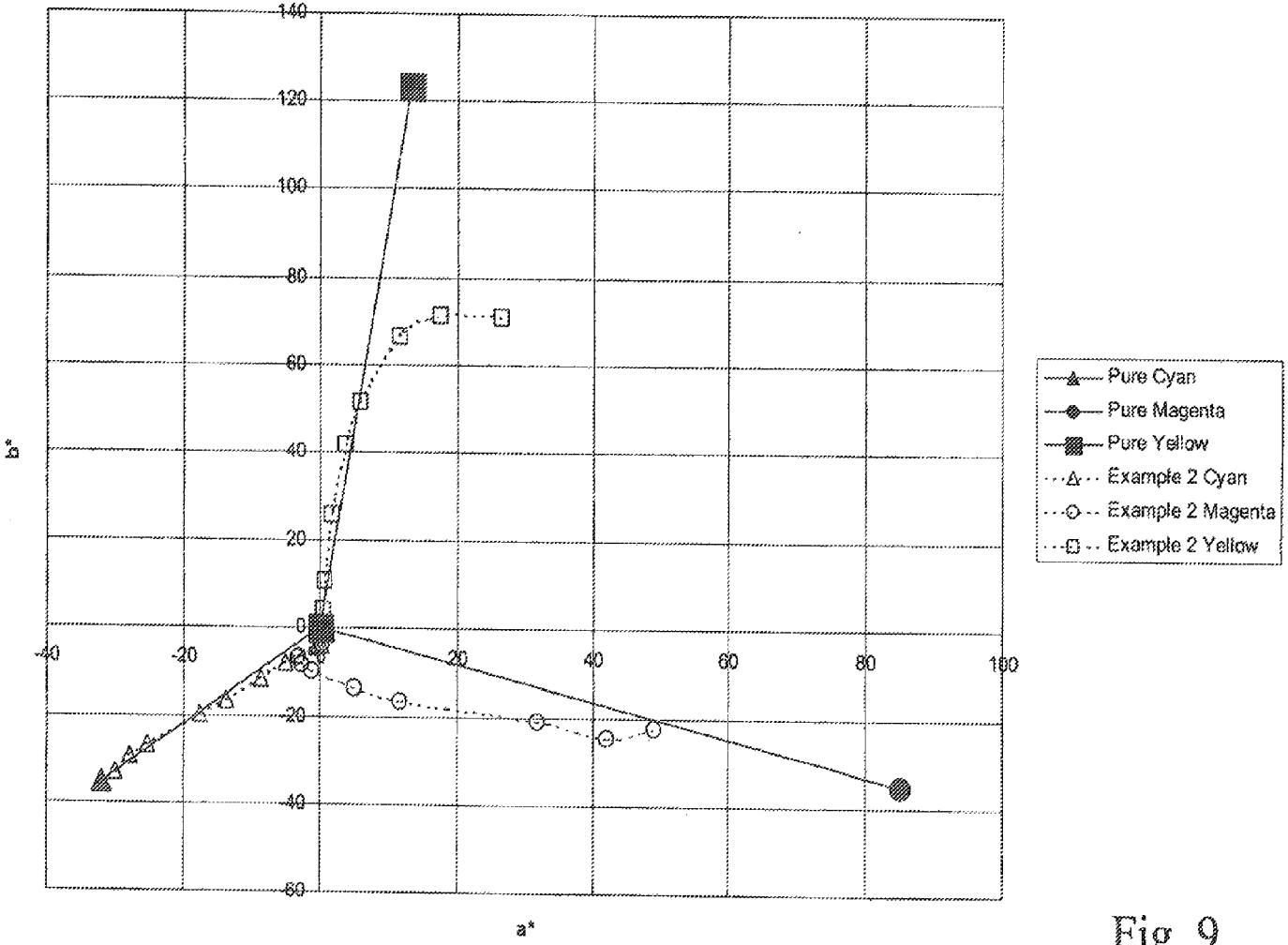
FIG. 9 is a chart showing the color gamut available with a preferred embodiment of the invention.

Each colored patch was measured as described in Example 1 above. The CIELab colors associated with each patch are shown in FIG. 9, in which only a* and b* values are shown. Also shown in FIG. 9 are the a* and b* values of the pure color formers at a reflection optical density of approximately 2.0.

It can be seen from FIG. 9 that using the method of the example, all three subtractive primary colors may be printed onto the thermal imaging member. It can also be seen that the color gamut available is larger than that of the method of Example 1. The yellow is the same as that of Example 1, and the cyan is similar to that of Example 1, but the color purity of magenta is significantly greater than that of Example 1.

In Example III the following printing parameters were used:

Printing head: KYT106-12PAN13 (Kyocera Corporation, 6 Takedatobadono-cho, Fushimi-ku, Kyoto, Japan)

Printing head width: 3.41 inch (106 mm print line width)

Pixels per inch: 300

Resistor size: 70×80 microns

Resistance: 3059 Ohm

Glaze thickness: 55 microns

Pressure: 1.5-2 lb/linear inch

Dot pattern: Rectangular grid.

Example III

This example illustrates a method of the present invention, in which the thermal imaging member prepared as described above was imaged in two printing passes, both at the same speed. In the first printing pass, the cyan and magenta color-forming layers were addressed at a baseline temperature of approximately 25 C. In the second printing pass, the yellow color-forming layer was addressed at a baseline temperature of approximately 60° C.

Both printing passes were carried out at 400 dpi in the transport direction. The voltage of 34 V was applied to the thermal printing head. The line cycle time of 16.7 ms was divided into 1001 individual pulses of varying duty cycle depending on the image-forming layer being addressed as indicated in the table below. The thermal imaging member was preheated by contact with material at the heat sink temperature over a distance of about 0.3 mm. Ten areas of the imaging member were printed for each color, ranging from Dmin (using the lowest number of pulses in the indicated range) to Dmax (using the maximum number of pulses in the indicated range).

| | Cyan | Magenta | Yellow |
|---|---|---|---|
| Heat sink temperature | 25° C. | | 58° C. |
| duty cycle | 74% | 17.5% | 5.9% |
| # pulses used | 17~39 | 190~300 | 440~872 |

Figure 10:
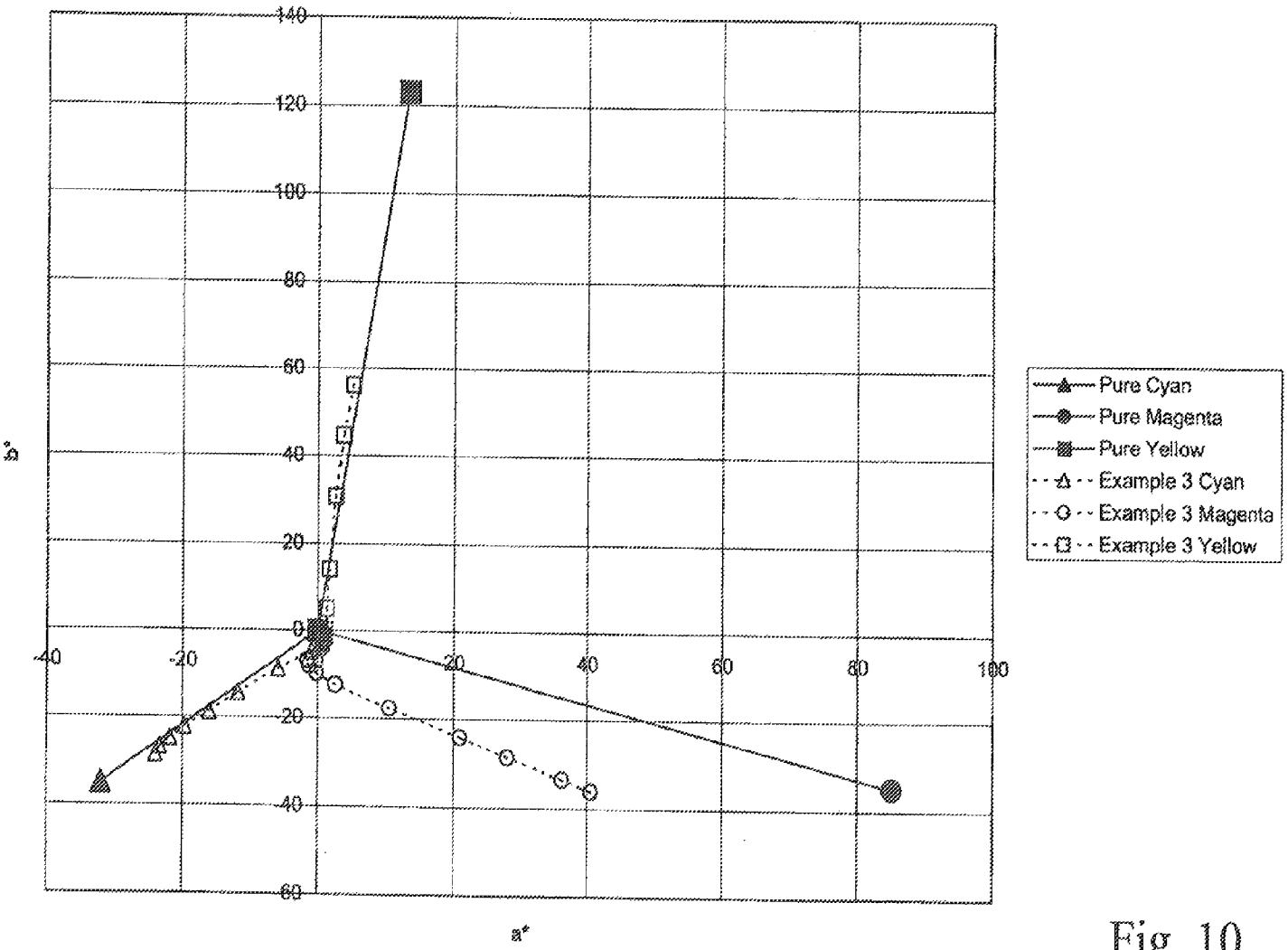
FIG. 10 is a chart showing the color gamut available with another preferred embodiment of the invention.

Each colored patch was measured as described in Example 1 above. The CIELab colors associated with each patch are shown in FIG. 10, in which only a* and b* values are shown. Also shown in FIG. 10 are the a* and b* values of the pure color formers at a reflection optical density of approximately 2.0.

It can be seen from FIG. 10 that using the method of this example, all three subtractive primary colors may be printed onto the thermal imaging member. It can also be seen that the color gamut available is larger than that of the method of Example I. The yellow is the same as that of Example I, and the cyan is similar to that of Example I, but the color purity of magenta is significantly greater than that of Example I.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

We claim:

1. A thermal imaging member comprising:

(a) a substrate comprising first and second opposed surfaces;

(b) a first oxygen barrier layer carried by one of said first and second surfaces;

(c) a first color-forming layer having an activating temperature of at least about 70° C. overlying said oxygen barrier layer;

(d) a first spacer layer or layers overlying said first color-forming layer;

(e) a second color-forming layer overlying said first spacer layer or layers, having an activating temperature at least about 30° C. above the activating temperature of said first color-forming layer;

(f) a second spacer layer or layers overlying said second color-forming layer;

(g) a third color-forming layer overlying said second spacer layer or layers, said third color-forming layer having an activating temperature at least about 30° C. above the activating temperature of said second color-forming layer;

(h) a second oxygen barrier layer overlying said third color-forming layer; and (i) an overcoat layer overlying said second oxygen barrier layer.

2. The thermal imaging member described in claim 1, further comprising a fluorescent brightener underlying said first spacer layer or layers.

3. The thermal imaging member described in claim 1, further comprising an ultraviolet-absorbing material overlying said third image-forming layer.

4. The thermal imaging member described in claim 1, wherein said third image-forming layer has an activating temperature of at least 200° C.

5. The thermal imaging member described in claim 1, wherein said first spacer layer or layers has at least three times the thickness of said second spacer layer or layers.

6. The thermal imaging member described in claim 1, wherein said first image-forming layer comprises a crystalline material that melts below 130° C., said second image-forming layer comprises a crystalline material that melts between 130° C. and 170° C., and said third image-forming layer comprises a crystalline material that melts above 170° C.

7. The thermal imaging member described in claim 1, wherein a fourth image-forming layer is carried by the surface of said substrate that does not carry said first, second and third image-forming layers.

8. The thermal imaging member described in claim 7 wherein said first and second oxygen barrier layers are absent.

* * * * *